United States Patent [19]

Mihayashi et al.

[11] Patent Number: 4,948,716

[45] Date of Patent: Aug. 14, 1990

[54] SILVER HALIDE COLOR PHOTOGRAPHIC MATERIAL

[75] Inventors: Keiji Mihayashi; Seiji Ichijima, both of Kanagawa, Japan

[73] Assignee: Fuji Photo Film Co., Ltd., Kanagawa, Japan

[21] Appl. No.: 268,617

[22] Filed: Nov. 7, 1988

[30] Foreign Application Priority Data

Apr. 30, 1985 [JP] Japan ..... 60-93326

[51] Int. Cl.[5] ..... G03C 1/46

[52] U.S. Cl. ..... 430/505; 430/504; 430/506; 430/955; 430/957

[58] Field of Search ..... 430/505, 506, 504, 955, 430/957

[56] References Cited

U.S. PATENT DOCUMENTS

| | | | |
|---|---|---|---|
| 3,227,554 | 1/1966 | Barr et al. | 430/382 |
| 3,379,529 | 4/1968 | Porter et al. | 430/452 X |
| 4,095,984 | 6/1978 | Sueyoshi et al. | 430/558 |
| 4,490,459 | 12/1984 | Iijima et al. | 430/505 |
| 4,500,633 | 2/1985 | Menju et al. | 430/505 |
| 4,524,130 | 6/1985 | Iwasa et al. | 430/505 |
| 4,618,571 | 10/1986 | Ichijima et al. | 430/505 |
| 4,770,982 | 9/1988 | Ichijima et al. | 430/505 |

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

The present invention is directed to a silver halide color photographic material including a blue-sensitive silver halide emulsion layer, a green-sensitive silver halide emulsion layer and a red-sensitive silver halide emulsion layer on a support, wherein at least one of the photosensitive layers comprises two or more unit layers having different sensitivities, and among all of said unit layers, the unit layer highest in sensitivity contains at least one of (a) a compound capable of producing, by the reaction of the compound with a developing agent oxidized product, a compound that can produce a development inhibitor or its precursor when oxidized, and (b) a compound capable of producing, by the reaction of the compound with a developing agent oxidized product, a precursor of a compound that can produce a development inhibitor or its precursor when oxidized, with the amount of said at least one of compounds (a) and (b) being at most 1 mol % based on the amount of the silver halide in said unit layer highest in sensitivity.

15 Claims, No Drawings

SILVER HALIDE COLOR PHOTOGRAPHIC MATERIAL

This is a continuation of application Ser. No. 857,286, filed Apr. 30, 1986, now abandoned.

FIELD OF THE INVENTION

The present invention relates to silver halide color photographic materials excellent in sharpness, graininess and color reproducibility.

BACKGROUND OF THE INVENTION

Recently, in silver halide photographic materials, in particular, photographing photosensitive materials, the demand is increasing for a super high-speed photosensitive material as represented by films of I.S.O. 1600 and a photosensitive material high in image quality and sharpness that is suitable for a small format camera such as a disk camera and a camera for 110 size.

Hitherto, it is known that as one of means for improving sharpness and graininess a compound that will release a development inhibitor correspondingly to the density of the image when development is carried out, which compound will be referred to as a "DIR compound" hereinafter, is contained in a silver halide color photographic material.

Generally, the DIR compounds are of the type that will release a development inhibitor when they react with the oxidized product of an aromatic primary amine developing agent, and typical examples of such DIR compounds are so-called DIR couplers in which a group is introduced on the coupling position thereof, which group can form a compound having a development inhibiting effect when it is released from the coupling position at the time of the coupling of the coupler (e.g., compounds disclosed in U.S. Pat. Nos. 3,227,554, 3,701,783, 4,095,984, 4,149,886, 3,933,500, 4,146,386, and 4,477,563). The DIR coupler is a compound that can form a dye from the coupler moiety as a result of a coupling reaction with the oxidized product of an aromatic primary amine developing agent while releasing a development inhibitor.

Examples of compounds that can form colorless dyes as a result of a coupling reaction with the oxidized product of an aromatic primary amine developing agent while releasing a development inhibitor are compounds disclosed, for example, in U.S. Pat. Nos. 3,632,345, 3,928,041, 3,958,993, 3,961,959, and 4,052,213, and Japanese Patent Application (OPI) Nos. 110529/78 and 13333/79 (the term "OPI" as used herein refers to a "published unexamined Japanese patent application").

Examples of so-called DIR hydroquinones that can release a development inhibitor as a result of a cross oxidation reaction with the oxidized product of a developing agent are compounds disclosed in U.S. Pat. Nos. 3,379,529 and 3,930,863.

However, these compounds are disadvantageous in that desensitization will take place, the function will lower due to the decomposition during the storage of the film after the application of the compound, or the effect for improving sharpness is unsatisfactory.

Examples of compounds whose splitting-off group will release a development inhibitor in a timed manner when coupled with the oxidized product of an aromatic primary amine developing agent are compounds disclosed in U.S. Pat. No. 4,248,962 and Japanese Patent Application (OPI) No. 56837/82.

When these compounds are used, since the effect of the inhibition can be exhibited at a position a certain distance away from the development silver halide grains, it has been assumed that sharpness would be improved due to the adjacency effect, but since the timing for releasing a splitting-off group is unsatisfactory these compounds have not improved sharpness. During the storage of the films, the compounds cannot avoid hydrolysis or cleavage under high humidity conditions, and therefore problems such as desensitization or lowering of the function occur.

To overcome these problems, Japanese Patent Application No. 33059/84 (corresponding to European Patent 0,157,146A2) discloses compounds that release a photographically useful group such as a development inhibitor by the coupling reaction with a developing agent oxidized product that will result in releasing a compound that will in turn undergo an oxidation-reduction reaction with another molecule of the developing agent oxidized product.

It is certain that the photosensitive materials containing, of these compounds, a compound that releases a development inhibitor in the end are excellent in storage stability and the sharpness has been improved. However, it has disadvantageously been found that if the compound is used in a large amount for a silver halide contained in the emulsion layer containing the compound, the development inhibiting effect is too high to lower the sensitivity excessively, or to make the adjustment of the gradation remarkably difficult, or the compound that is released after the reaction of the developing agent oxidized product and can react with another molecule of the developing agent oxidized product adversely affects to lower the sensitivity, or the sharpness is adversely affected due to the undesirable adjacency development effect by the part that reacts with the developing agent oxidized product.

On the other hand, compounds partly similar to those that will be obtained by excluding the development inhibitor part from the present compounds are disclosed in Japanese Patent Application (OPI) No. 138636/82 and U.S. Pat. No. 4,477,560. These compounds are completely different from the present compounds in that, as a constituent for scavenging the color development agent oxidized product, only the split-off part acts, and therefore as claimed in U.S. Pat. No. 4,477,560, a large amount, that is, from 1 to 5% mol, of the compound to be added for the silver halide contained in the same photosensitive emulsion layer is required, and if a large amount is added the desensitization effect is not high inview of photographic performance. In contrast therewith, if the present compound is added in such a large amount, remarkable desensitization would take place.

SUMMARY OF THE INVENTION

The object of the present invention is to provide a silver halide color photographic material excellent in sharpness, grainines and color reproducibility.

The object of the present invention has been attained by providing a silver halide color photographic material including a blue-sensitive silver halide emulsion layer, a green-sensitive silver halide emulsion layer and a red-sensitive silver halide emulsion layer on a support, wherein at least one of the photosensitive layers comprises two or more unit layers having different sensitivities, and among all of said unit layers, the unit layer highest in sensitivity contains at least one of (a) a compound capable of producing, by the reaction of the compound with a developing agent oxidized product, a compound that can produce a development inhibitor or its precursor when oxidized, and (b) a compound capable of producing, by the reaction of the compound with a developing agent oxidized product, a precursor of a compound that can produce a development inhibitor or its precursor when oxidized, with the amount of said at least one of the compounds (a) and (b) being at most 1 mol% based on the amount of the silver halide in said unit layer highest in sensitivity.

DETAILED DESCRIPTION OF THE INVENTION

The compounds (a) capable of producing, by the reaction of the compound with a developing agent oxidized product, a compound that can produce a development inhibitor or its precursor when oxidized, and the compounds (b) capable of producing, by the reaction of the compound with a developing agent oxidized product, a precursor of a compound that can produce a development inhibitor or its precursor when oxidized include those having the general formula (I):

$$A\text{-}B\text{-}D \qquad (I)$$

wherein A represents a coupler residue that will split the linkage between A and B by the reaction with a developing agent oxidized product, B represents a group that will split the linkage between B and D when the linkage with A is split and then B is oxidized or its precursor, and D represents a development inhibitor or its precursor.

Preferably, B in the general formula (I) represents the following general formula (B-1):

$$*\text{—}(B_1)_v\text{—}\underset{\underset{(B_2)_w}{|}}{RED}\text{—}** \qquad (B\text{-}1)$$

wherein the mark * indicates the position to be attached to A and the mark ** indicates the position to be attached to D, B1 represents a joining group that will split from RED after the linkage between $B_1$ and A has split, $B_2$ represents a group that will split from RED when reacting with an alkali, hydroxylamine or sulfite ion that is present when development is carried out, RED represents a group that will have an oxidisable structure only after the linkages between RED and $B_1$ and between RED and $B_2$ have split and will split from D (having the same meaning as defined in formula (I)) when oxidized, and v and w each are 0 or 1.

Preferably, the group represented by RED is that having the following general formula (R-1):

$$*\text{—}P\text{-}(X=Y_nQ)\text{-}** \qquad (R-1)$$

wherein the mark * indicates the position to be attached to A—$(B_1)_v$—, and the mark ** indicates the position to be attached to B (when w=1) or a hydrogen atom (when w=0), and P and Q each represents an oxygen atom or a substituted or unsubstituted imino group, at least one of X in a quantity of n and Y in a quantity of n represents a methylene group having, as a substituent, D (having the same meaning as defined in the general formula (I)), and the remaining X and Y may be the same or different and each represents a substituted or unsubstituted methine group or a nitrogen atom, and n is an integer of from 1 to 3, two substituents of any of which P, X, Y and Q may be divalent groups to form a ring structure.

Preferably, $B_1$ in the general formula (B-1) includes:

(1) groups that use the split-off reaction of hemiacetals, for example, those described in U.S. Pat. No. 4,146,396, and Japanese Patent Application Nos. 106223/84, 106224/84, and 75475/84 (corresponding to Japanese Patent Application (OPI) Nos. 249148/85, 249129/85 and 218645/85, respectively) and having the following general formula:

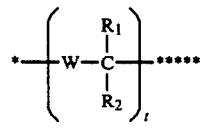

wherein the mark * indicates the position to be attached to A, and the mark ***** indicates the position to be attached to RED, and W represents an oxygen atom or a group

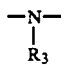

in which $R_3$ represents an organic substituent, $R_1$ and $R_2$ may be the same or different and each represents a hydrogen atom or a substituent, and t is 1 or 2, two of any of which $R_1$, $R_2$ and $R_3$ may join together to form a ring structure, (2) groups that cause the split-off reaction using an intramolecular nucleophilic substitution reaction, for example, timing groups described in U.S. Pat. No. 4,248,962, and (3) groups that cause the split-off reaction using the electron transfer reaction along a conjugated system, for example, groups described in U.S. Pat. No. 4,409,323 or groups (see British Patent 2,096,783 A) having the following general formula:

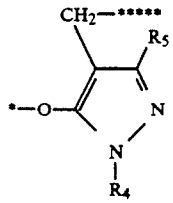

wherein the mark * indicates the position to be attached to A, and the mark ***** indicates the position to be attached to RED, and $R_4$ and $R_5$ each represents a hydrogen atom or a substituent.

Representative examples of the substituent represented by $R_1$ or $R_2$ include acyl groups (e.g., a benzoyl group, an acetyl group, etc.), carbamoyl groups (e.g., an N-ethylcarbamoyl group, an N-phenylcarbamoyl group, etc.) and aliphatic groups (e.g., a methyl group, a butyl group, etc.). Examples of the organic substituent represented by R3 include acyl groups (e.g., an acetyl group, a benzoyl group, etc.), sulfonyl groups (e.g., a methanesulfonyl group, a benzenesulfonyl group, etc.), aliphatic groups (e.g., a methyl group, an ethyl group, etc.) and carbamoyl groups (e.g., an ethylcarbamoyl group, a phenylcarbamoyl group, etc.). Representative examples of the ring structure formed by join any two of $R_1$, $R_2$ and $R_3$ include a group represented by the following general formula:

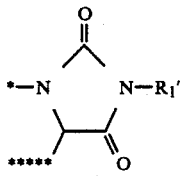

wherein the mark * indicates the position to be attached to A and the mark ***** indicates the position to be attached to RED, and $R_1'$ preferably represents aliphatic groups containing 1 to 5 carbon atoms (e.g., a methyl group, an ethyl group, a butyl group, etc.) or a hydrogen atom. Preferred examples of the substituent represented by $R_4$ include aliphatic groups (e.g., a methyl group, a benzyl group, etc.), and aromatic groups (e.g., a phenyl group, a 2,4,6-trichlorophenyl group, etc.). Preferred examples of the substituent represented by $R_5$ include aliphatic groups (e.g., a methyl group, an ethyl group, etc.), aromatic groups (e.g., a phenyl group, a 4-methoxyphenyl group, etc.) and alkoxycarbonyl groups (e.g., a methoxycarbonyl group, an ethoxycarbonyl group, etc.).

$B_2$ in the general formula (B-1) represents a group that will split from RED when reacting with a nucleophilic agent such as a sulfurous acid ion or hydroxylamine present in a developer or with an alkali. Preferably, examples of such groups include a hydrolyzable group such as an acyl group, alkoxycarbonyl group, aryloxycarbonyl group, carbamoyl group, imidoyl group, oxazolyl group, and sulfonyl group, precursor groups of the type that use the reverse Michael reaction as described in U.S. Patent 4,009,029, precursor groups of the type that use as an intramolecular nucleophilic group an anion produced after a ring cleavage reaction as described in U.S. Patent 4,310,612, precursor groups as described in U.S. Patents 3,674,478, 3,932,480 or 3,993,661 wherein an anion undergoes electron transfer through the conjugated system thereby causing a split reaction, precursor groups as described in U.S. Patent 4,335,200 wherein a split reaction is caused by the electron transfer of an anion produced after a ring cleavage, and precursor groups that use an imidomethyl as described in U.S. Patents 4,363,865, and 4,410,618.

Preferably, in the general formula (B-1), v is 0 and w is 0.

Preferably, in the general formula (I), D is represented by the following formula (D-1):

$$******\text{-}(B_1)_q\text{-}DI \qquad (D\text{—}1)$$

wherein the mark * indicates the position to be attached to B, and $B_1$ has the same meaning as defined for the general formula (B-1), q is 0 or 1 and DI represents a development inhibitor.

Preferably, DI includes a tetrazolylthio group, 1- or 2-benzotriazolyl group, 1-benzoindazolyl group, benzoimidazolylthio group, benzoxazolylthio group, imidazolylthio group, oxazolylthio group, triazolylthio group, oxadiazolylthio group, thiadiazolylthio group or N-aryl-N-(1,2,3,4-thiatriazol-5-yl)amino group.

An N-aryl-N-(1,2,3,4-thiatriazol-5-yl)amino group itself does not have a development inhibiting effect (after split) but its rearrangement produces 5-mercapto-1-phenyltetrazole thereby exhibiting a inhibiting effect (a reaction described in West German Patent Application (OLS) No. 3,307,506 A). the development inhibitors mentioned above may be have a substituent mentioned below at any substitutable position. Examples of such substituents are aliphatic groups (e.g., a methyl group, ethyl group, etc.), aromatic groups (e.g., a phenyl group, 4-chlorophenyl group, etc.), halogen atoms (e.g., a fluorine atom, chlorine atom, etc.), alkoxy groups (e.g., a methoxy group, benzyloxy group, etc.), alkylthio groups (e.g., an ethylthio group, butylthio group, etc.), aryloxy groups (e.g., a phenoxy group), arylthio groups (e.g., a phenylthio group), carbamoyl groups (e.g., an N-ethylcarbamoyl group), a alkoxycarbonyl groups (e.g., a methoxycarbonyl group), aryloxycarbonyl groups (e.g., a phenoxycarbonyl group), sulfonyl groups (e.g., a benzensulfonyl group and methanesulfonyl group), sulfamoyl groups (e.g., an N-ethylsulfamoyl group), acylamino groups (e.g., an acetamido group, and benzamido group), sulfonamido groups (e.g., a methanesulfonamido group, and benzenesulfonamido group), acyl groups (e.g., an acetyl group, and benzoyl group), a nitroso group, acyloxy groups (e.g., an acetoxy group), ureido groups (e.g., a 3-phenylureido group, and 3-ethylureido group), imido groups (e.g., a succinimido group), a nitro group, a cyano group, heterocyclic groups (e.g., 4- to 6-membered heterocyclic groups containing a nitrogen atom, oxygen atom or sulfur atom as a hetero atom, such as a 2-furyl group, 2-pyridyl group, 1-imidazolyl, and 1-morpholino group), a hydroxyl group, carboxyl groups, alkoxycarbonylamino groups (e.g., a methoxycarbonylamino group, and phenoxycarbonylamino group), a sulfo group, an amino group, anilino groups (e.g., a 4-methoxyanilino group), aliphatic amino groups (e.g., a diethylamino group), sulfinyl groups (e.g., an ethylsulfinyl group), sulfamoylamino groups (e.g., an ethylsulfamoylamino group), thioacyl groups (e.g., a phenylthiocarbonyl group), thioureido groups (e.g., 3-phenylthoureido group) and heterocyclic amino groups (e.g., an imidazolylamino group). When there is an aliphatic group in the substituents mentioned above, the aliphatic group is such that it contains 1 to 22 atoms, preferably 1 to 10 carbon atoms, and may have a chain structure or ring structure, and may be linear or branched, saturated or unsaturated or substituted or unsubstituted.

When there is an aromatic group in the substituents mentioned above, the carbon number in the aromatic group is 6 to 10, and preferably the aromatic group is a substituted or unsubstituted phenyl group.

Preferably, in the general formula (D-1), q is 0.

Preferred couplers in the general formula (I) are those corresponding to the following formulae (II) and (III):

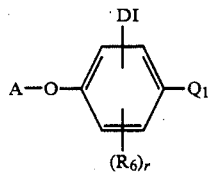

(II)

-continued (III)

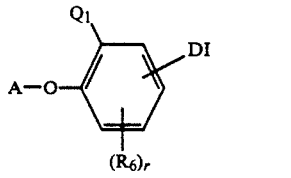

wherein A and DI have the same meaning as defined above, $Q_1$ represents a hydroxyl group or sulfonamido group, $R_6$ represents a hydrogen atom or a substituent, for example, preferably one selected from the substituents for the group represented by DI in the general formula (D-1) mentioned above, particularly preferably one selected from alkoxy groups (e.g., a methoxy group, an ethoxy group, etc.), a hydroxyl group, sulfonamido groups (e.g., a methanesulfonamido group, a benzenesulfonamido group, etc.), acylamino groups (e.g., an acetamido group, a benzamido group, etc.), aliphatic groups (e.g., a methyl group, an ethyl group, etc.) or alkylthio group (e.g., a methylthio group, a butylthio group, etc.), and r is an integer of from 1 to 3, and if r is 2 or over, $R_6$'s may be the same or different, and if two $R_6$'s represent substituents on adjacent carbon atoms, they may be divalent groups to form a ring structure. The ring structure may be a benzene condensed ring such as benzonorbornenes, chromans, indoles, benzothiophenes, quinolines, benzofurans, 2,3-dihydrobenzofurans, indanes, indenes, etc.

When $Q_1$ represents a sulfonamido group, it is selected preferably from aliphatic sulfonamido, aromatic sulfonamido, or heterocyclic sulfonamido groups. Particularly, the aliphatic sulfonamido group is an aliphatic sulfonamido group having 1 to 20 carbon atoms, preferably 1 to 10 carbon atoms, that may be linear or branched, chainlike or cyclic, saturated or unsaturated and substituted or unsubstituted. Particularly, the aromatic sulfonamido group is a substituted or unsubstituted naphthyl group or a substituted or unsubstituted phenyl group having 6 to 10 carbon atoms.

Particularly, as the heterocyclic ring group of the heterocyclic sulfonamido group is mentioned a 4- to 7-membered heterocyclic ring group containing as a hetero atom a nitrogen atom, a sulfur atom or an oxygen atom.

In the general formula (I), in particular, A includes yellow coupler residues (e.g., open chain ketomethylene coupler, etc.), magenta coupler residues (e.g., 5-pyrazolone, pyrazolotriazole, pyrazoloimidazole, etc.), cyan coupler residues (e.g., phenol, naphthol, etc.), colorless coupler residues (e.g., indanone, acetophenone, etc.), etc. As a yellow coupler moiety can be mentioned those described in U.S. Pat. Nos. 3,265,506, 2,875,057, and 3,408,194, Japanese Patent Application (OPI) Nos. 29432/73, 66834/73, 13329/79, and 87650/75, etc., as a magenta coupler moiety can be mentioned those described in U.S. Pat. Nos. 2,600,788, 3,062,653, 3,127,269, 3,419,391, 3,519,429, and 3,888,680, Japanese Patent Application (OPI) Nos. 111631/74, 171956/84, and 162548/84, etc. and as a cyan coupler moiety can be mentioned those described in U.S. Pat. Nos. 2,474,293, 2,801,171, 3,476,563, 4,009,035, and 4,333,999, Japanese Patent Application (OPI) Nos. 112038/75, 117422/75, 32071/80, and 109630/78, *Research Disclosure* (RD) No. 15741, Japanese Patent Application (OPI) No. 204545/82, etc. As a coupler moiety that would not substantially form a dye can be mentioned those described in U.S. Pat. Nos. 3,958,993, and 3,961,959, etc.

The present invention is particularly effective, when A in the general formula (I) represents a coupler residue represented by the following general formulae (Cp-1), (Cp-2), (Cp-3), (Cp-4), (Cp-5), (Cp-6), (Cp-7), (Cp-8), (Cp-9), (Cp-10) or (Cp-11). These couplers are preferable in that their coupling speed is high.

(Cp-1)

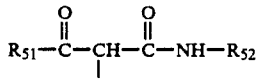

(Cp-2)

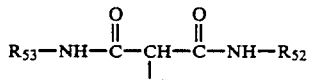

(Cp-3)

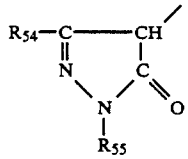

(Cp-4)

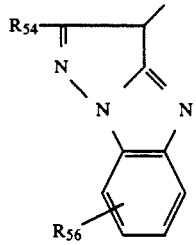

(Cp-5)

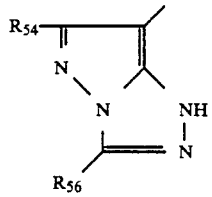

(Cp-6)

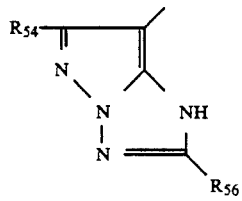

(Cp-7)

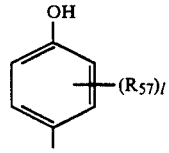

(Cp-8)

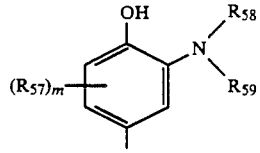

-continued

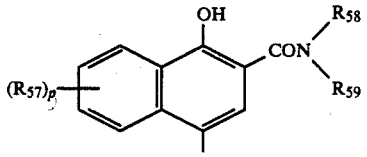

(Cp-9)

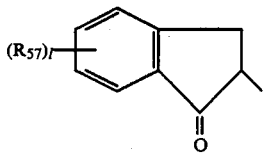

(Cp-10)

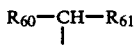

(Cp-11)

The free bond line extending from the coupling position indicates the bonding position of the coupling splitting-off group. In the above formulae, in the case where $R_{51}$, $R_{52}$, $R_{53}$, $R_{54}$, $R_{55}$, $R_{56}$, $R_{57}$, $R_{58}$, $R_{59}$, $R_{60}$ or $R_{61}$ contains a nondifusible group, it should be selected such that the total number of carbon atoms is 8 to 32, preferably 10 to 22, and in other cases, the total number of carbon atoms should preferably be up to 15.

Descriptions of $R_{51}$ to $R_{61}$, l, m and p in the above general formulae (Cp-1) to Cp-11) are given below.

$R_{51}$ represents an aliphatic group, an aromatic group, an alkoxy group or a heterocyclic group, and $R_{52}$ to $R_{53}$ each represent an aromatic group or a heterocyclic ring group.

The aliphatic group represented by $R_{51}$ preferably contains 1 to 22 carbon atoms and may be substituted or unsubstituted and chainlike or cyclic. A preferred substituent for the alkyl group is an alkoxy group, aryloxy group, amino group, and acylamino group, a halogen atom, etc., which may be substituted itself. Examples of useful aliphatic groups represented by $R_{51}$ are: an isopropyl group, isobutyl group, tert-butyl group, isoamyl group, tert-amyl group, 1,1-dimethylbutyl group, 1,1-dimethylhexyl group, 1,1-diethylhexyl group, dodecyl group, hexadecyl group, octadecyl group, cyclohexyl group, 2-methoxyisopropyl group, 2-phenoxyisopropyl group, 2-p-tert-butylphenoxyisopropyl group, α-aminoisopropyl group, α-(diethylamino)isopropyl group, α-(succinimido)isopropyl group, α-(phthalimido)isopropyl group, α-(benzenesulfonamido)isopropyl group, etc.

When $R_{51}$, $R_{52}$ or $R_{53}$ represents an aromatic group, in particular, a phenyl group, the aromatic group may be substituted. The aromatic group including a phenyl group may be substituted by an alkyl group, alkenyl group, alkoxy group, alkoxycarbonyl group, alkoxycarbonylamino group, aliphatic amido group, alkylsulfamoyl group, alkylsulfonamido group, alkylureido group, alkyl-substituted succinimido group or the like that has up to 32 carbon atoms, wherein the alkyl moiety may have in the chain an aromatic group such as a phenylene. the phenyl group may also be substituted by an aryloxy group, aryloxycarbonyl group, arylcarbamoyl group, arylamido group, arylsulfamoyl group, arylsulfonamido group, arylureido group or the like, wherein the aryl moiety may further be substituted by one or more alkyl groups having a sum of 1 to 22 carbon atoms.

The phenyl group represented by $R_{51}$, $R_{52}$ or $R_{53}$ may also be substituted by an amino group (that may be substituted by a 1-6 C lower alkyl group), hydroxy group, carboxyl group, sulfo group, nitro group, cyano group, or thiocyano group or a halogen atom.

The phenyl group represented by $R_{51}$, $R_{52}$ or $R_{53}$ may be other substituents that are formed by condensing rings, for example, a naphthyl group, quinolyl group, isoquinolyl group, chromanyl group, coumaranyl group, tetrahydronaphthyl group, etc. Each of these substituents itself may have a substituent.

In the case when $R_{51}$ represents an alkoxy group, the alkyl moiety represents a linear or branched alkyl group, alkenyl group, cycloalkyl group or alkenyl group that contains 1 to 32 carbon atoms, preferably 1 to 22 carbon atoms and may be substituted by a halogen atom, an aryl group, alkoxy group, etc.

When $R_{51}$, $R_{52}$ or $R_{53}$ represents a heterocyclic ring group, the heterocyclic ring group links with the nitrogen atom of the amido group or the carbon atom of the carbonyl group of the acyl group of the alpha-acylacetamido via one carbon atom forming the ring. Examples of such a heterocyclic ring include thiophene, furan, pyran, pyrrole, pyrazole, pyridine, pyrazine, pyrimidine, pyridazine, indolizine, imidazole, thiazole, oxazole, triazine, thiadiazine, oxazine, etc. that may be substituted.

$R_{55}$ in the general formula (Cp-3) represents a 1-32 C, preferably 1-22 C, linear or branched alkyl group (e.g., a methyl group, isopropyl group, tert-butyl group, hexyl group, dodecyl group, etc.), an alkenyl group (e.g., an allyl group), a cycloalkyl group (e.g., a cyclopentyl group, cyclohexyl group, norbornyl group, etc.), aralkyl group (e.g., a benzyl group, β-phenylethyl group, etc.), a cyclic alkenyl group (e.g., a cyclopentenyl group, cyclohexenyl group, etc.), etc. that may be substituted by a halogen atom, a nitro group, cyano group, aryl group, alkoxy group, aryloxy group, carboxy group, alkylthiocarbonyl group, arylthiocarbonyl group, alkoxycarbonyl group, aryloxycarbonyl group, sulfo group, sulfamoyl group, carbamoyl group, acylamino group, diacylamino group, ureido group, urethane group, thiourethane group, sulfonamido group, heterocyclic ring group, arylsulfonyl group, alkylsulfonyl group, arylthio group, alkylthio group, alkylamino group, dialkylamino group, anilino group, N-arylanilino group, N-alkylanilino group, N-acylanilino group, hydroxyl group, mercapto group, or the like.

$R_{55}$ may represent an aryl group (e.g., a phenyl group, α- or β-naphthyl group, etc.). The aryl group may have one or more substituents, for example, an alkyl group, alkenyl group, cycloalkyl group, aralkyl group, cycloalkenyl group, halogen atom, nitro group, cyano group, aryl group, alkoxy group, aryloxy group, carboxyl group, alkoxycarbonyl group, aryloxycarbonyl group, sulfo group, sulfamoyl group, carbamoyl group, acylamino group, diacylamino group, ureido group, urethane group, sulfonamido group, heterocyclic ring group, arylsulfonyl group, alkylsulfonyl group, arylthio group, alkylthio group, alkylamino group, dialkylamino group, anilino group, N-alkylanilino group, N-arylanilino group, N-acylanilino group, hydroxyl group, or the like.

$R_{55}$ may represent a heterocyclic ring group (e.g., a 5- or 6-membered heterocyclic ring group or condensed heterocyclic ring group containing as a hetero-atom a nitrogen atom, oxygen atom or sulfur atom such as a pyridyl group, quinolyl group, furyl group, benzothiazolyl group, oxazolyl group, imidazolyl group, naphthoxazolyl group, etc.), or a heterocyclic ring group that may have a substituent mentioned for the above aryl group, or an aliphatic or aromatic acyl group, alkylsulfonyl group, arylsulfonyl group, alkylcarbamoyl group, arylcarbamoyl group, alkylthiocarbamoyl group or arylthiocarbamoyl group.

In the above formula, $R_{54}$ represents a hydrogen atom, a 1-32 C, preferably 1-22 C, linear or branched alkyl group, alkenyl group, cycloalkyl group, aralkyl group, cycloalkenyl group, aryl group, or heterocyclic group, that each may have the substituent mentioned for the group represented by $R_{55}$, an alkoxycarbonyl group (e.g., a methoxycarbonyl group, ethoxycarbonyl group, stearyloxy carbonyl group, etc.), aryloxycarbonyl group (e.g., a phenoxycarbonyl group, naphthoxycarbonyl group, etc.), aralkyloxycarbonyl group (e.g., benzyloxycarbonyl group, etc.), alkoxy group (e.g., a methoxy group, ethoxy group, heptadecyloxy group, etc.), aryloxy group (e.g., a phenoxy group, tolyloxy group, etc.), alkylthio group (e.g., an ethylthio group, dodecylthio group, etc.), arylthio group (e.g., a phenylthio group, α-naphthylthio group, etc.), carboxyl group, acylamino group (e.g., acetylamino group, 3-[(2,4-di-tert-amylphenoxy)acetamido]benzamido, etc.), diacylamino group, N-alkylacylamino group (e.g., an N-methylpropionamido group, etc.), N-arylacylamino group (e.g., an N-phenylacetamido group, etc.), ureido group (e.g., a ureido group, N-arylureido group, N-alkylureido group, etc.), urethane group, thiourethane group, arylamino group (e.g., a phenylamino group, N-methylanilino group, diphenylamino group, N-acetylanilino group, 2-chloro-5-tetradecaneanilino group, etc.), alkylamino group, (e.g., an n-butylamino group, methylamino group, cyclohexylamino group, etc.), cycloamino group (e.g., piperidino group, pyrrolidino group, etc.), heterocyclic amino group (e.g., a 4-pyridylamino group, 2-benzoxazolylamino group, etc.), alkylcarbonyl group (e.g., a methylcarbonyl group, etc.), arylcarbonyl group (e.g., a phenylcarbonyl group, etc.), sulfonamido group (e.g., an alkylsulfonamido group, arylsulfonamido group, etc.), carbamoyl group (e.g., an ethylcarbamoyl group, dimethylcarbamoyl group N-methyl-phenylcarbamoyl group, N-phenylcarbamoyl group, etc.), sulfamoyl group (e.g., an N-alkylsulfamoyl group, N,N-dialkylsulfamoyl group, N-arylsulfamoyl group, N-alkyl-N-arylsulfamoyl group, N,N-diarylsulfamoyl group, etc.), cyano group, hydroxy group, or sulfo group.

$R_{56}$ in the above formula represents a hydrogen atom or a 1-32 C, preferably 1-22 C, linear or branched alkyl group, alkenyl group, cycloalkyl group, aralkyl group or cycloalkenyl group, that each may have the substituent mentioned for the group represented by $R_{55}$ above.

$R_{56}$ may also represent an aryl or heterocyclic ring group, that each may have the substituent mentioned for the group represented by $R_{55}$.

$R_{56}$ may also represent a cyano group, alkoxy group, aryloxy group, halogen atom, carboxyl group, alkoxycarbonyl group, aryloxycarbonyl group, acyloxy group, sulfo group, sulfamoyl group, carbamoyl group, acylamino group, diacylamino group, ureido group, urethane group, sulfonamido group, arylsulfonyl group, alkylsulfonyl group, arylthio group, alkylthio group, alkylamino group, dialkylamino group, anilino group, N-alkylanilino group, N-arylanilino group, N-acylanilino group, hydroxyl group, or the like.

$R_{57}$, $R_{58}$ and $R_{59}$ each represent a group that is used generally in a 4-equivalent type phenol or α-naphthol coupler, and as examples of $R_{57}$ may be mentioned a hydrogen atom, halogen atom, alkoxycarbonylamino group, aliphatic hydrocarbon residue, N-arylureido group, or acylamino group, or —O—$R_{62}$ or —S—$R_{62}$ where $R_{62}$ represents an aliphatic hydrocarbon residue, and two or more of $R_{57}$ in the molecule may be different and the aliphatic hydrocarbon residue may have a substituent.

When the substituents have an aryl group, the aryl group may have the substituent mentioned for the group represented by $R_{55}$ above.

$R_{58}$ and $R_{59}$ each can be selected from an aliphatic hydrocarbon residue, an aryl group and a heterocyclic ring residue, one of $R_{58}$ and $R_{59}$ may be a hydrogen atom, each of these may have a substituent, and R and R59 may together form a nitrogen-containing heterocyclic nucleus.

The hydrocarbon aliphatic residue may be saturated or unsaturated, linear or branched or cyclic and preferably is an alkyl group (e.g., a methyl group, ethyl group, propyl group, isopropyl group, butyl group, t-butyl group, isobutyl group, dodecyl group, octadecyl group, cyclobutyl group, cyclohexyl group, etc.) or alkenyl group (e.g., an allyl group, octenyl group, etc.). As an aryl group may be exemplified a phenyl group, and naphtyl group, and as a heterocyclic ring residue may be exemplified a pyridyl group, quinolyl group, thienyl group, piperidyl group, imidazolyl group, etc. Examples of a substituent that may be introduced to these aliphatic hydrocarbon residues, aryl groups and heterocyclic residues include a halogen atom, nitro group, hydroxy group, carboxyl group, amino group, substituted amino group, sulfo group, alkyl group, alkenyl group, aryl group, heterocyclic ring group, alkoxy group, aryloxy group, arylthio group, arylazo group, acylamino group, carbamoyl group, ester group, acyl group, acyloxy group, sulfonamido group, sulfamoyl group, sulfonyl group, morpholino group, etc.

l is an integer of from 1 to 4, m is an integer of from 1 to 3 and p is an integer of from 1 to 5.

$R_{60}$ represents an arylcarbonyl group, 2-32 C, preferably 2-22, alkanoyl group, arylcarbamoyl group, 2-32 C, preferably 2-22 C, alkanecarbamoyl group, 1-32 C, preferably 2-22 C, alkoxycarbonyl group or aryloxycarbonyl group, that each may have a substituent such as an alkoxy group, alkoxycarbonyl group, acylamino group, alkylsulfamoyl group, alkylsulfonamido group, alkylsuccinimido group, halogen atom, nitro group, carboxyl group, nitrile group, alkyl group or aryl group.

$R_{61}$ represents an arylcarbonyl group, 2-32 C, preferably 2-22 C, alkanoyl group, arylcarbamoyl group, 2-32 C, preferably 2-22 C, alkanecarbamoyl group, 1-32 C, preferably 1-22 C, alkoxycarbonyl group or aryloxycarbonyl group, 1-32 C, preferably 1-22 C, alkylsulfonyl group, arylsulfonyl group, aryl group or 5- or 6-membered heterocyclic ring group (containing as a heteroatom, a nitrogen atom, oxygen atom or sulfur atom such as a triazolyl group, imidazolyl group, phthalimido group, succinimido group, furyl group, pyrizyl group or benzotriazolyl group), that each may have the substituent mentioned for the group represented b $R_{60}$ above.

Of the above coupler residues, as a yellow coupler residue, preferably, in the general formula (Cp-1), $R_{51}$ represents a t-butyl group or substituted or unsubstituted aryl group, and $R_{52}$ represents a substituted or unsubstituted aryl group, and in the general formula (Cp-2), $R_{52}$ and $R_{53}$ each represent a substituted or unsubstituted aryl group.

As a magenta coupler residue, preferably, in the general formula (Cp-3), $R_{54}$ represents an acylamino group, ureido group, or arylamino group, and R represents a substituted aryl group, in the general formula (Cp-4), $R_{54}$ represents an acylamino group, ureido group or arylamino group, and $R_{56}$ represents a hydrogen atom and, in the general formulae (Cp-5) and (Cp-6), $R_{54}$ and $R_{56}$ each representsa linear or branched alkyl group, alkenyl group, cycloalkyl group, aralkyl group or cycloalkenyl group.

As a cyan coupler residue, preferably, in the general formula (Cp-7), $R_{57}$ represents an acylamino group or ureido group in the 2-position, an acylamino group or alkyl group in the 5-position and a hydrogen atom or chlorine atom in the 6-position, and in the general formula (Cp-9), $R_{57}$ represents a hydrogen atom, acylamino group, sulfonamido group or alkoxycarbonyl group in the 5-position, R58 represents a hydrogen atom, and $R_{59}$ represents a phenyl group, alkyl group, alkenyl group, cycloaralkyl group, aralkyl group, or cycloalkenyl group.

As a colorless coupler residue, preferably, in the general formula (Cp-10), $R_{57}$ represents an acylamino group, sulfonamido group or sulfamoyl group, and in the general formula (Cp-11), $R_{60}$ and $R_{61}$ each represent an alkoxycarbonyl group.

Any part of $R_{51}$ to $R_{61}$ may form a bis-form or more higher polymeric form, and any part of the groups may have an ethylenically unsaturated group to form a polymer of a monomer or a copolymer with a color non-developing monomer.

When the coupler residue of the present invention represents a polymer, it means a polymer having repeating units corresponding to the general formula (Cp-13) derived from a monomer coupler of the following general formula (Cp-12), or a copolymer of the monomer coupler of the following general formula (Cp-12) with one or more of a color non-developing monomer containing at least one ethylene group with no coupling ability with the oxidized product of an aromatic primary amine developing agent. In this case, two or more monomer couplers may be polymerized simultaneously.

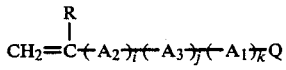

(Cp-12)

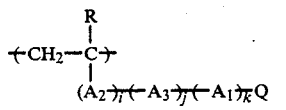

(Cp-13)

In the above formulae, R represents a hydrogen atom, 1-4 C lower alkyl group, or chlorine atom, $A_1$ represents —CONR'—, —NR'CONR'—, —NR'COO—, —COO—, —$SO_2$—, —CO—, —NR'CO—, —$SO_2$NR'—, —NR'$SO_2$—, —OCO—, —OCONR'—, —NR'or —O—, $A_2$ represents —CONR'— or —COO—, and R' which may be the same or different represents a hydrogen atom, aliphatic group, or aryl group.

$A_3$ represents 1-10 C unsubstituted or substituted alkylene group or aralkylene group or unsubstituted or substituted arylene group, which alkylene group may be linear or branched.

Examples of the alkylene group are methylene group, methylmethylene group, dimethylmethylene group, dimethylene group, trimethylene group, tetramethylene group, pentamethylene group, hexamethylene group, decylmethylene group, an example of the aralkylene group is a benzylidene group and an example of the arylene group is a phenylene group, naphthylene group, etc.

Q represents a group that will attach to a coupler or polymer of the general formula (Cp-12) or (Cp-13) at part of any one of $R_1$-$R_{11}$ in the general formulae (Cp-1) to (Cp-11).

i, j and k each are 0 or 1.

Substituents of the alkylene group, aralkylene group and arylene group represented by $A_3$ include an aryl group (e.g., a phenyl group), nitro group, hydroxyl group, cyano group, aulfo group, alkoxy group (e.g., a methoxy group), aryloxy group (e.g., a phenoxy group), acyloxy group (e.g., an acetoxy group), acylamino group (e.g., an acetylamino group), sulfonamido group (e.g., a methanesulfonamido group), sulfamoyl group (e.g., a methylsulfamoyl group), halogen atom (e.g., a fluorine, chlorine, bromine atom, etc.), carboxyl group, carbamoyl group (e.g., a methylcarbamoyl), alkoxycarbonyl group (e.g., a methoxycarbonyl group), and sulfonyl group (e.g., a methylsulfonyl group). When there are two or more substituents, they may be the same or different.

Color non-developing ethylenic monomers that would not couple with the oxidized product of an aromatic primary amine developing agent include acrylic acid, α-chloroacrylic acid, and α-alkylacrylic acids [e.g., esters and amides derived from acrylic acids such as acrylic acid or methacrylic acid (e.g., acrylamide, methacrylamide, t-butylacrylamide, methyl acrylate, methyl methacrylate, ethyl acrylate, n-propyl acrylate, iso-propyl acrylate, n-butyl acrylate, t-butyl acrylate, n-butyl methacrylate, 2-ethylhexyl acrylate, n-hexyl acrylate, n-octyl acrylate, lauryl acrylate, and methylenebisacrylamide)], vinyl esters (e.g., vinyl acetate, vinyl propionate, and vinyl laurate), acrylonitrile, methacrylonitrile, aromatic vinyl compounds (e.g., styrene and its derivatives, vinyltoluene, divinylbenzene, vinylacetophenone, and sulfostyrene), itaconic acid, citraconic acid, crotonic acid, vinylidene chloride, vinyl alkyl ether (e.g., vinyl ethyl ether), maleates, N-vinyl-2-pyrrolidone, N-vinylpyridine, 2- and 4-vinylpyridines, etc. Particularly, acrylates, methacrylates and maleates are preferred. Two or more color non-developing ethylenically unsaturated monomers can be used in the form of mixtures. For example, a combination of n-butyl acrylate and divinylbenzene, styrene and methacrylic acid, or n-butyl acrylate and methacrylic acid is possible.

Examples of (a) a compound capable of producing, by the reaction of the compound with a developing agent oxidized product, a compound that can produce a development inhibitor or its precursor when oxidized, or (b) a compound capable of producing, by the reaction of the compound with a developing agent oxidized product, a precursor of a compound that can produce a development inhibitor or its precursor when oxidized are given below, which are not intended to limit the scope of the invention.

(1)
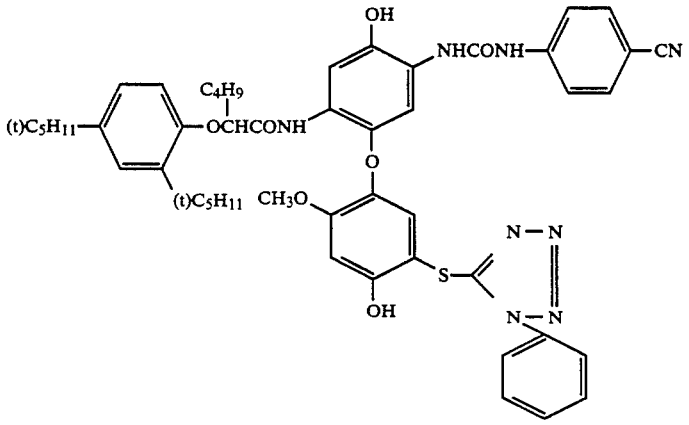
(2)
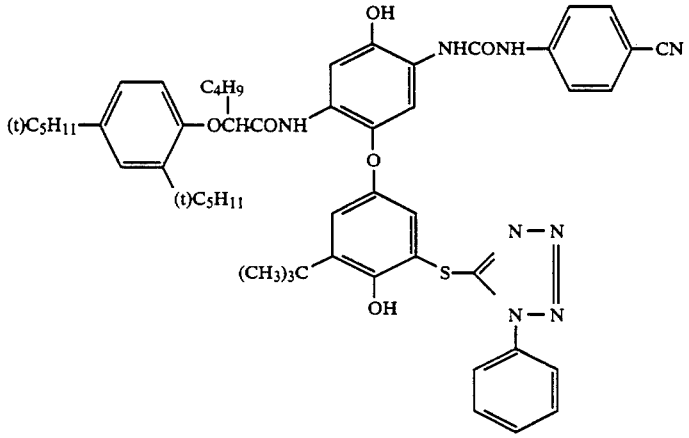
(3)
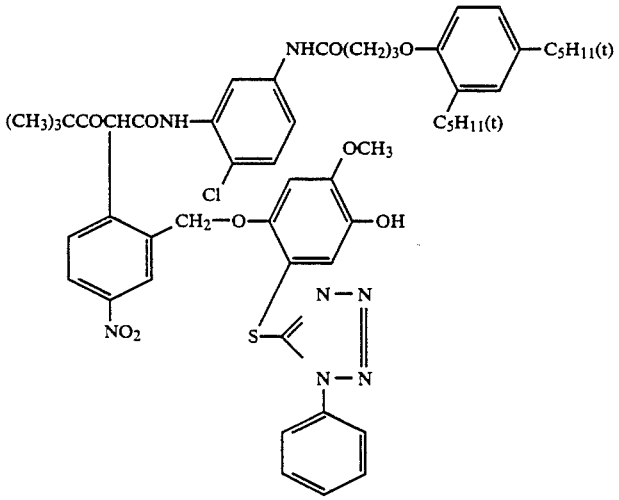

-continued
(4)
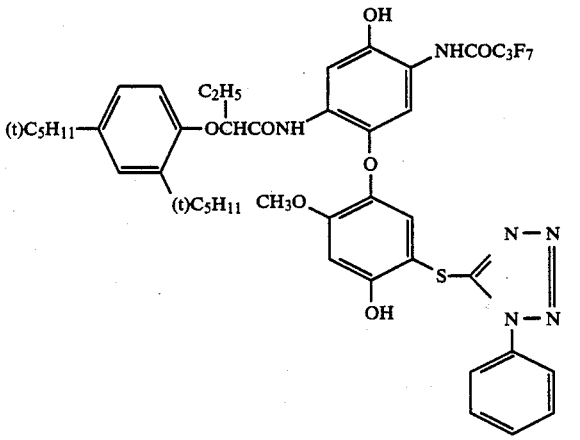
(5)
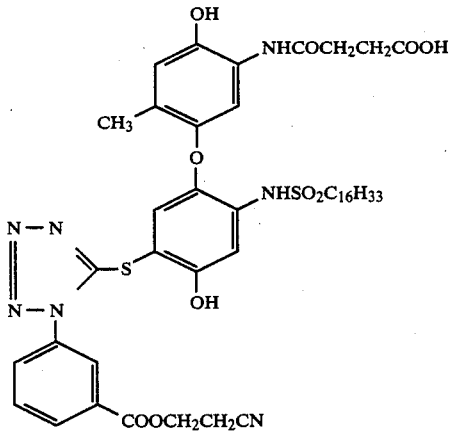
(6)
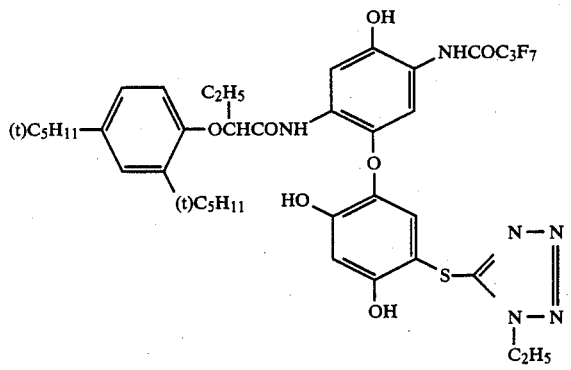
(7)
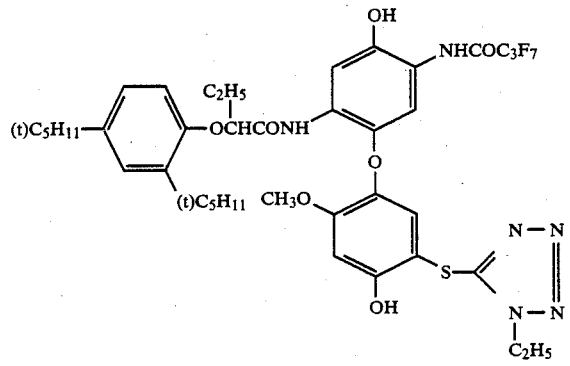

-continued
(8)
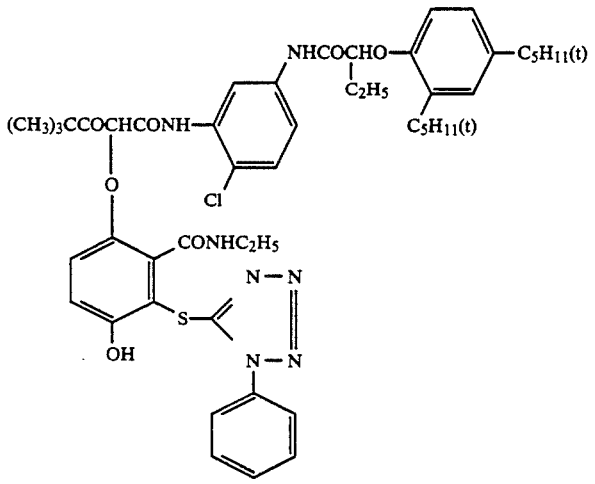
(9)
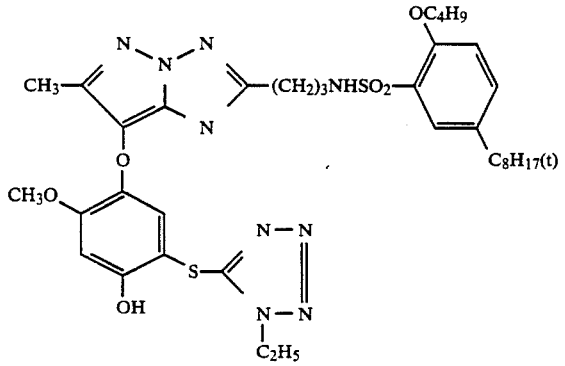
(10)
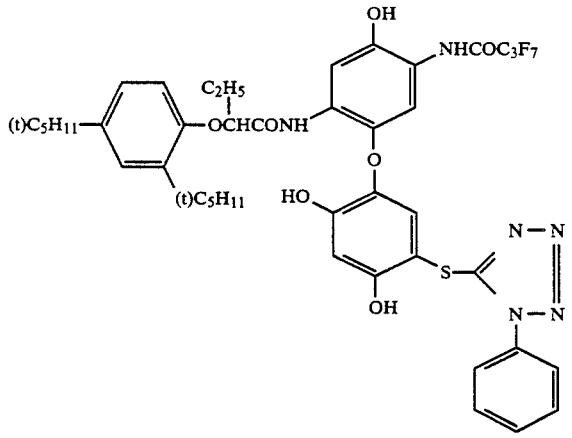
(11)
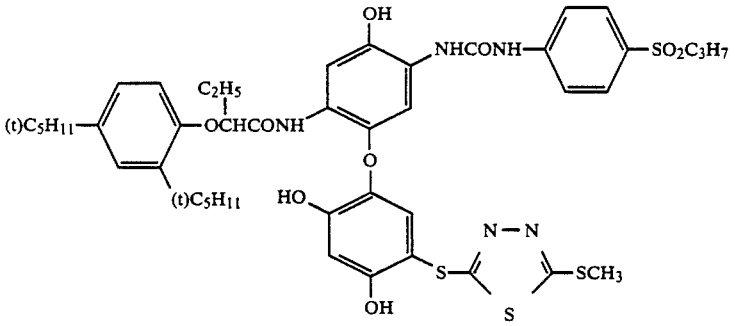

-continued
(12)
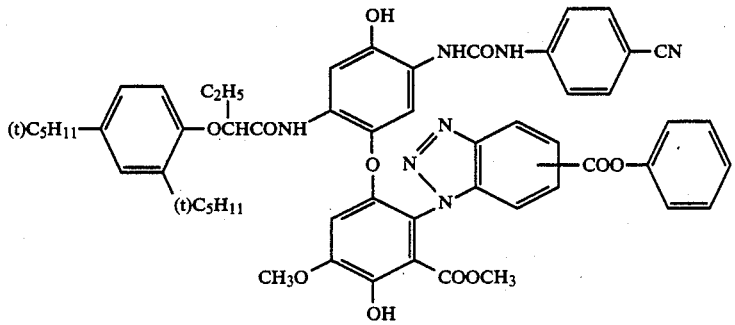
(13)
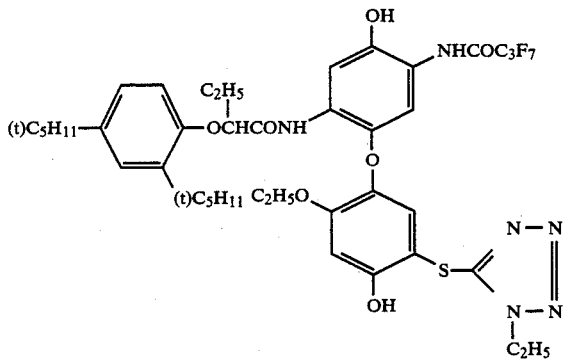
(14)
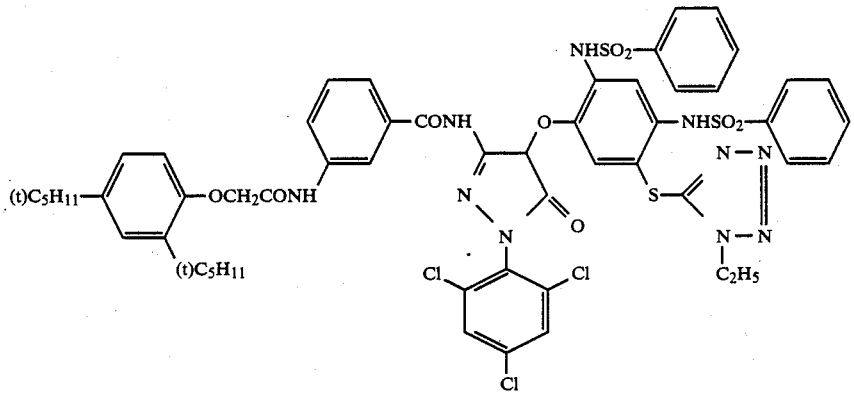
(15)
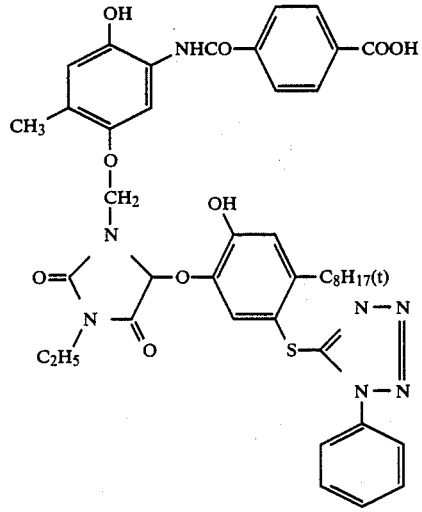

-continued
(16)
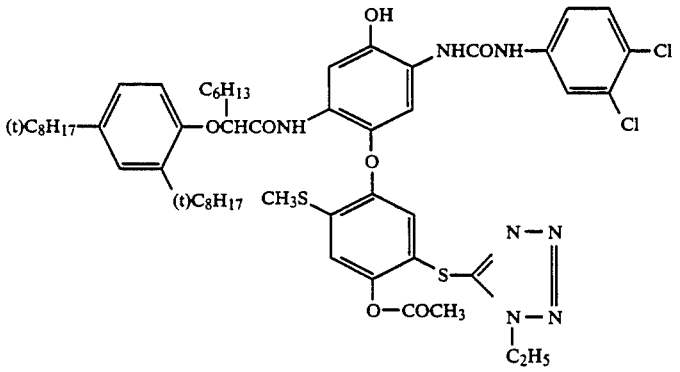
(17)
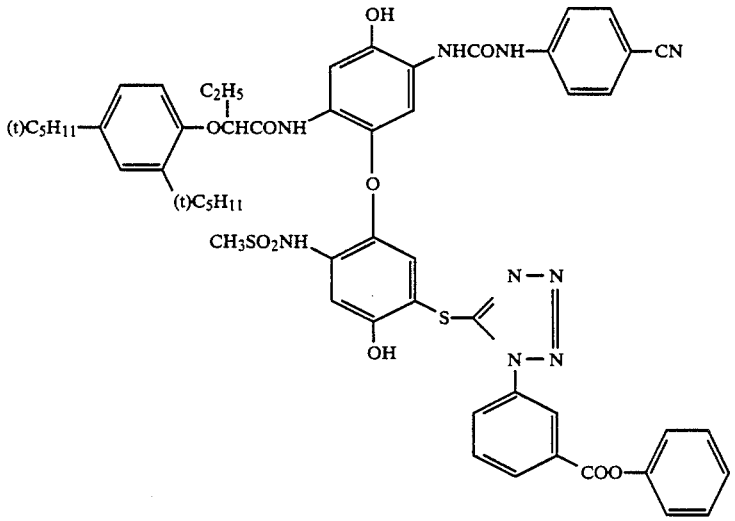
(18)
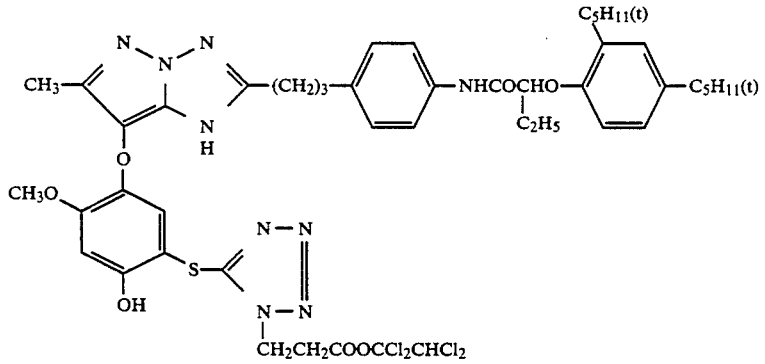
(19)
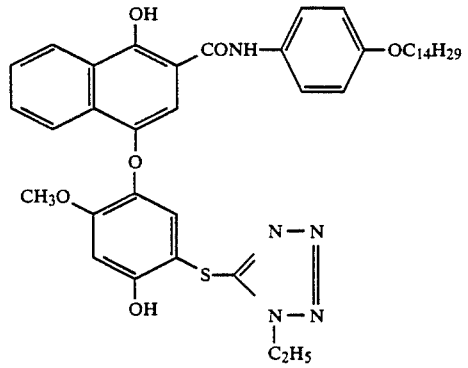

-continued
(20)
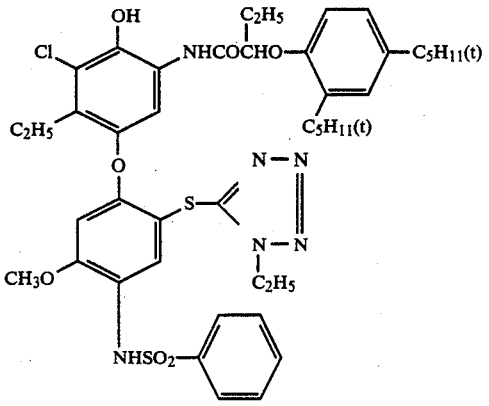
(21)
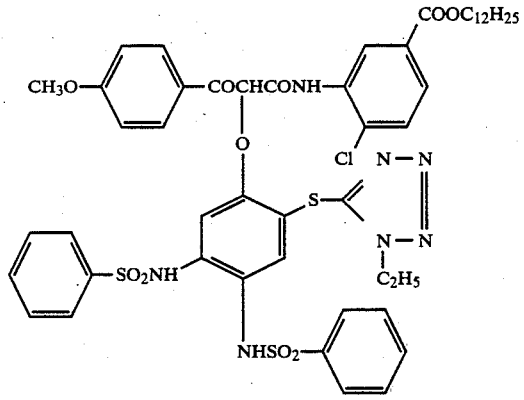
(22)
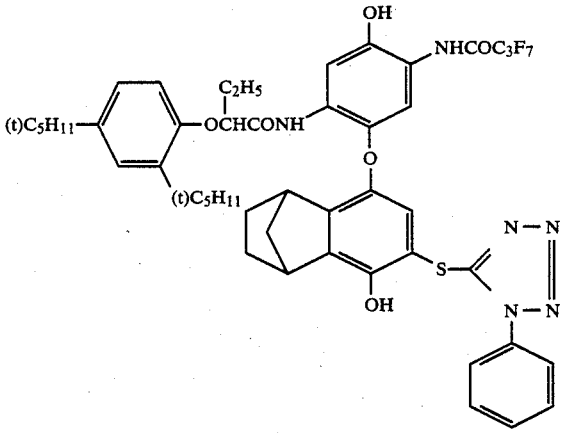
(23)
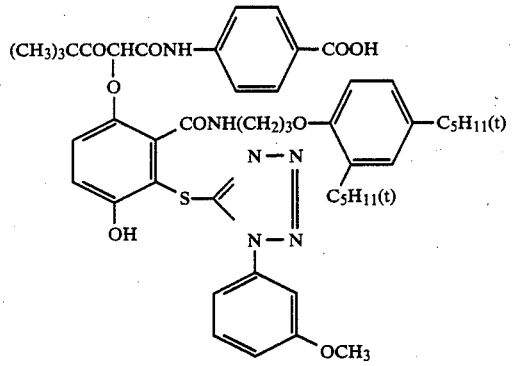

-continued
(24)
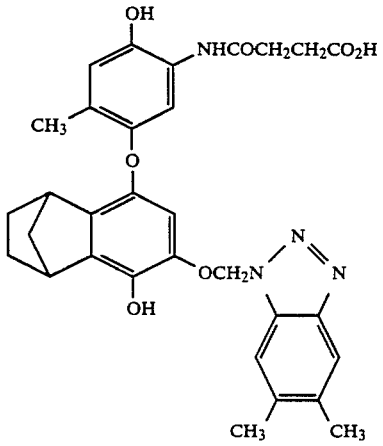
(25)
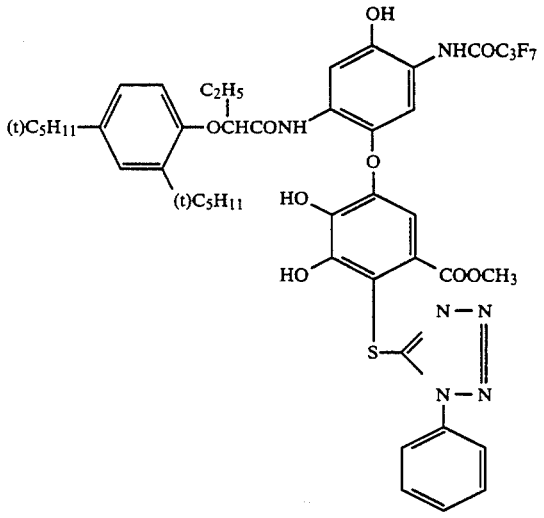
(26)
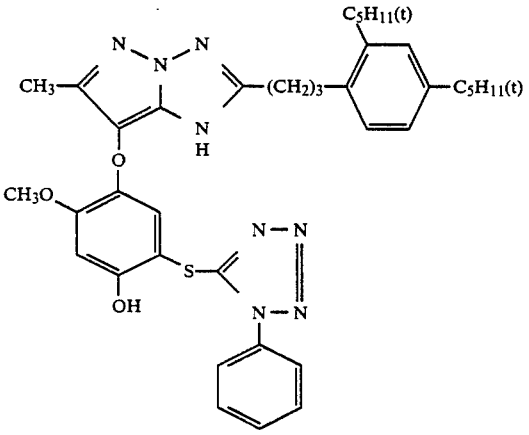

-continued
(27)
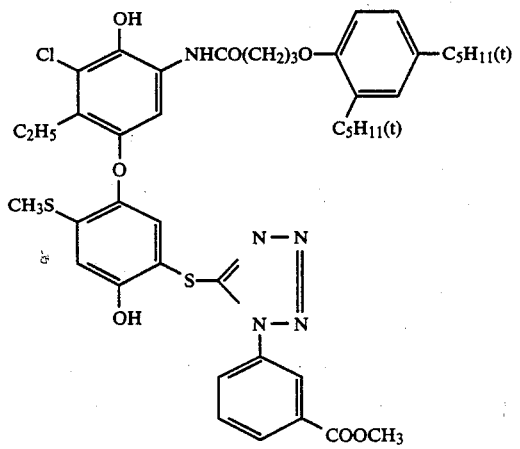
(28)
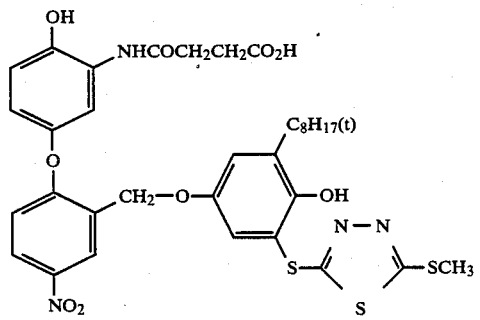
(29)
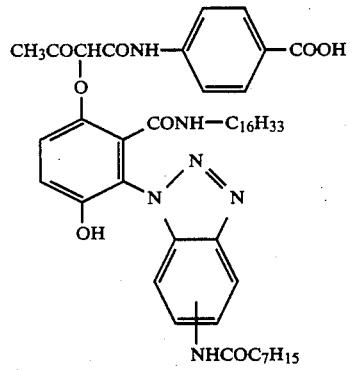
(30)
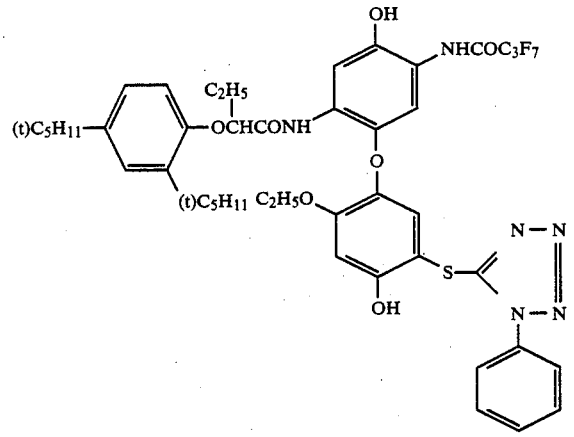

-continued
(31)
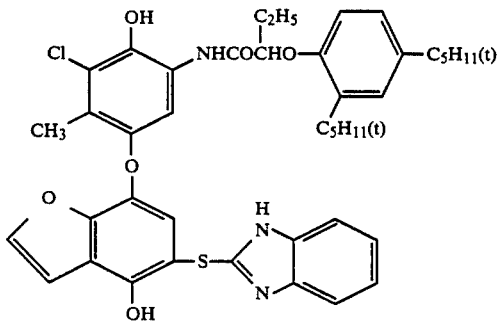
(32)
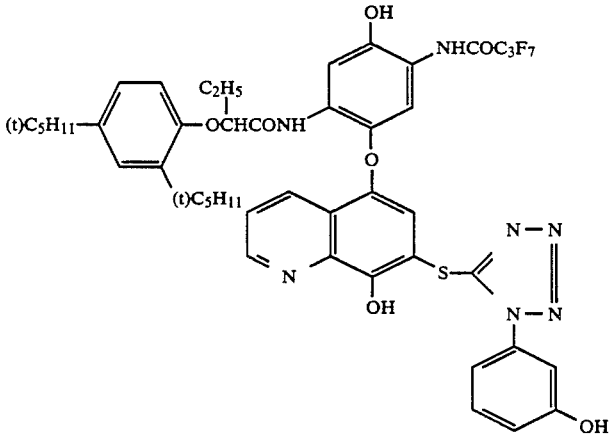
(33)
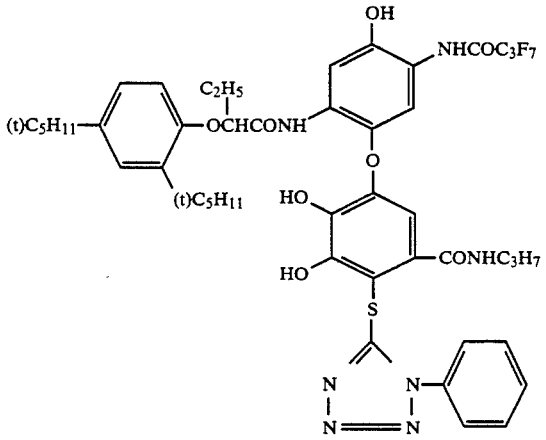
(34)
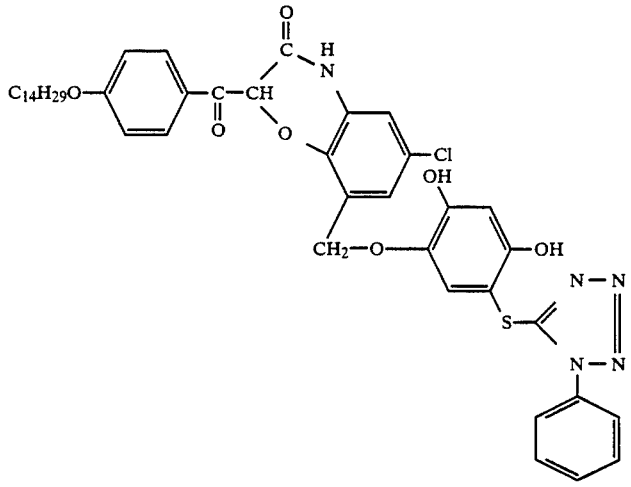

-continued
(35)
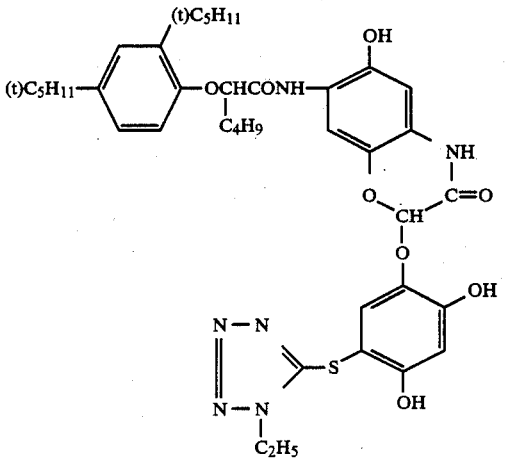
(36)
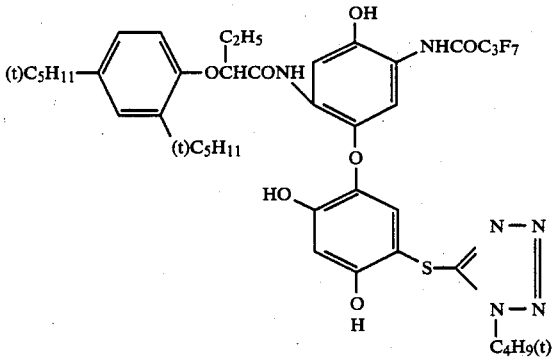
(37)
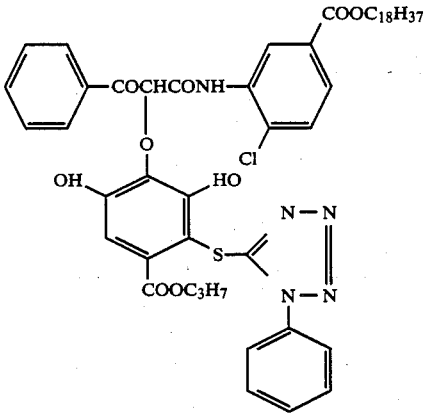
(38)
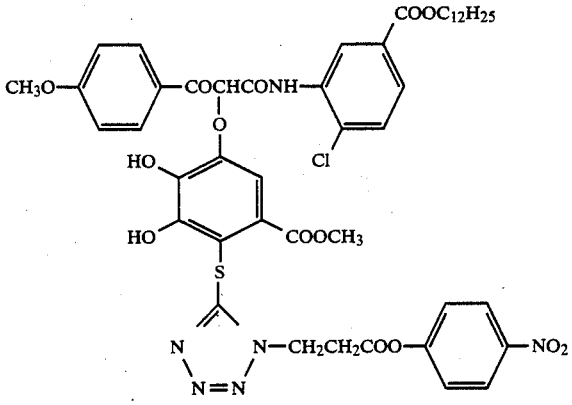

-continued (39)

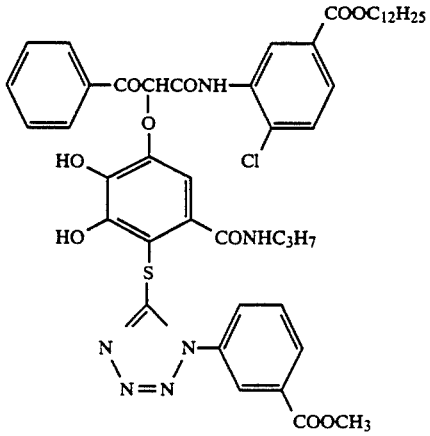

(40)

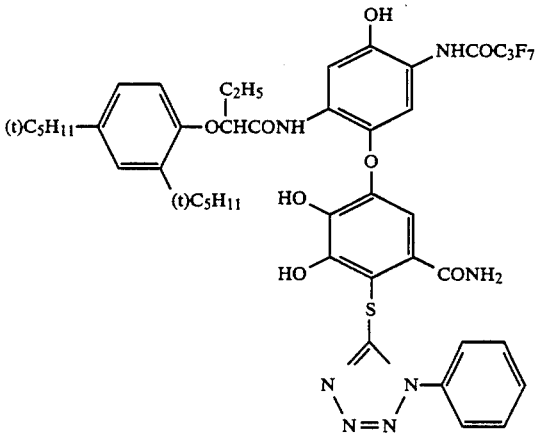

(41)

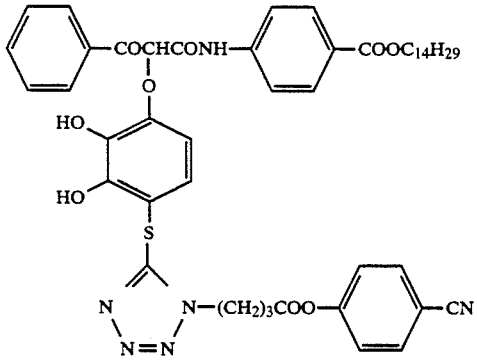

The compounds represented by the general formula (I) can be synthesized by the methods described in Japanese Patent Application Nos. 33059/84, and 136973/84 (corresponding to European Patent 157,146A2 and Japanese Patent Application (OPI) No. 15142/86, respectively), U.S. Pat. No. 4,248,962, British Patent (published) 2,072,363, and Japanese Patent Application Nos. 72378/85 and 72379/85 by Fuji Photo Film Co., Ltd. filed Apr. 5, 1985, Japanese Patent Application No. 75040/85 by Fuji Photo Film Co., Ltd. filed Apr. 8, 1985, Japanese Patent Application No. 78013/85 by Fuji Photo Film Co., Ltd. filed Apr. 12, 1985, and Japanese Patent Application No. 80021/85 by Fuji Photo Film Co., Ltd. filed Apr. 15, 1985.

In the following, examples of the synthesis of the compound of the present invention are set forth. Other compounds can be prepared in synthesis similar to the following synthesis.

Synthesis (1): Synthesis of illustrative compound (4)

The illustrative compound (4) was prepared by the following synthesis:

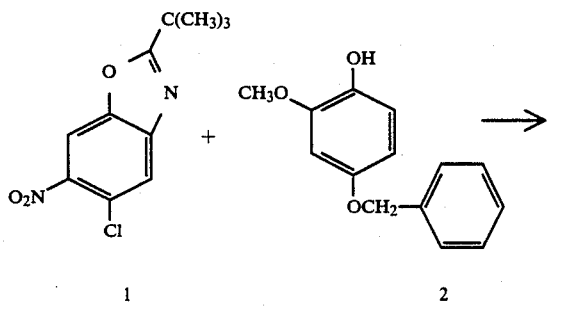

1 2

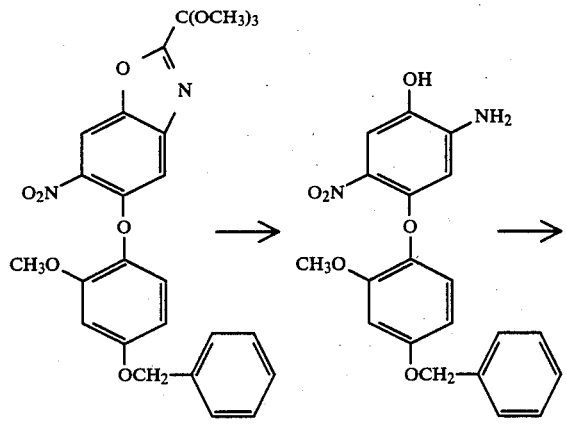

3 4

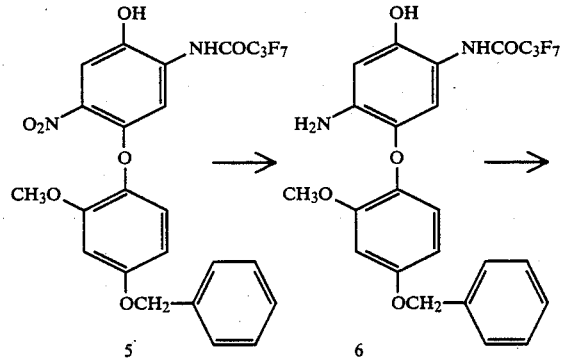

5 6

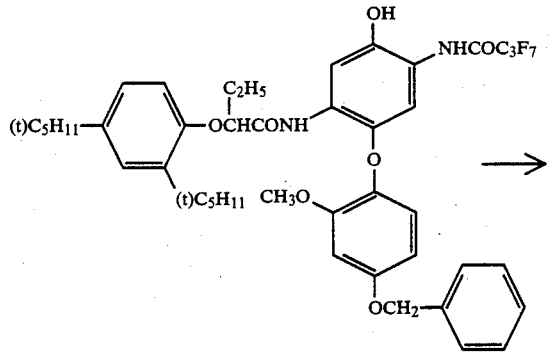

7

-continued

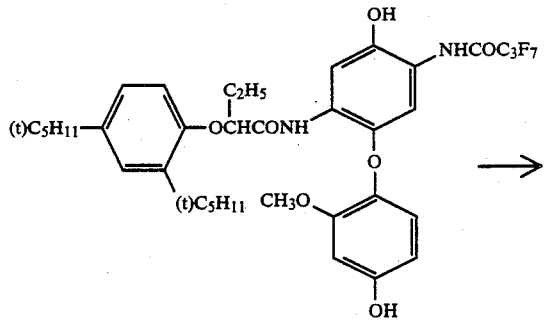

8

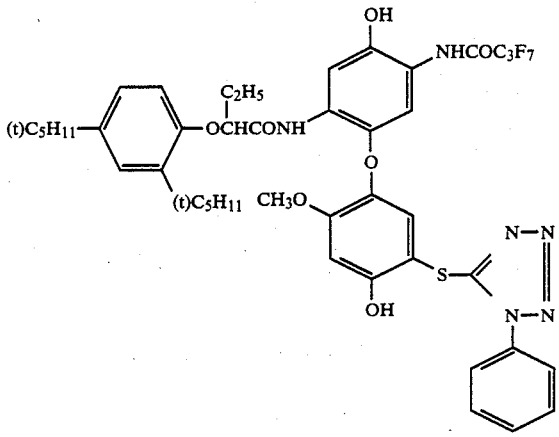

Compound (4)

Step 1: Synthesis of intermediate compound 3

62 g of the compound 2, 18 g of caustic soda and ml of water were added to 700 ml of toluene. The admixture was heated under reflux in an atmosphere of nitrogen for 1 hour. From the reaction solution were distilled off water and toluene as azeotropic mixture. To the residue was added 200 ml of N,N-dimethylformamide and the admixture was heated at a temperature of 100° C. To the heated admixture was added 57 g of the compound 1. After the admixture underwent a reaction at a temperature of 100° C. for 1 hour, the reaction solution was allowed to cool down to room temperature and then ethyl acetate was added to the cooled solution. The solution was transferred to a separating funnel and it was washed with water. After the ethyl acetate phase was separated, the solvent was removed under reduced pressure to obtain 53 g of the oil residue containing, as a main component, the compound 3.

Step 2: Synthesis of intermediate compound 4

53 g of the compound 3 which had been prepared in Sept 1 was dissolved in a mixed solvent of 400 ml of ethanol and 120 ml of water. 40 g of potassium hydroxide was added to the solution. After the solution was heated under reflex for 4 hours, the reaction solution was mixed with hydrochloric acid until neutralization was reached. The neutralized solution was then transferred to a separating funnel together with ethyl acetate and water. After the ethyl acetate phase was separated, the solvent was distilled off to obtain 43 g of the oil residue containing, as a main component, the compound 4.

Step 3: Synthesis of intermediate compound 5

43 g of the compound 4 which had been prepared in Step 2 was dissolved in 300 ml of ethyl acetate. 69 g of anhydrous heptafluoropropionic acid was dropwise added to the solution at room temperature. After the solution underwent a reaction for 30 minute, to the reaction solution was added water. The solution was then transferred to a separating funnel and it was washed with water. After the oil phase was separated, the solvent was distilled off. The residue was column-chromatographed to isolate and purify the objective compound on silica gel with 2.5% ethanol-containing chloroform eluents. 47 g of oil compound 5 was obtained.

Step 4: Synthesis of intermediate compound 6

47 g of the compound 5 which had been prepared in Step 3, 36.3 g of iron filings and 10 ml of acetic acid were added to a mixed solvent of 40 ml of water and 400 ml of isopropanol. The admixture was heated under reflux for 1 hour. While the solution thus refluxed was hot, it was filtered. The filterate was concentrated until the amount thereof became about half. The crystals thus precipitated were filtered off to obtain 44 g of the compound 6.

Step 5: Synthesis of intermediate compound 7

44 g of the compound 6 which had been prepared in Step 4 was added to 400 ml of acetonitrile and the admixture was heated under reflux. 28 g of 2-(2,4-di-t-amylphenoxy)butanoyl chloride was added dropwise to the refluxed admixture. After the solution was heated under reflux for 30 minutes, it was allowed to cool down to room temperature. Ethyl acetate was added to the reaction solution. The reaction solution was then transferred to a separating funnel and it was washed with water. After the oil phase was separated, the solvent was distilled off under reduced pressure. The residue was recrystallized from acetonitrile to obtain 60 g of the compound 7.

Step 6: Synthesis of intermediate compound 8

60 g of the compound 7 which had been prepared in Step 5 was added to 500 ml of dichloromethane. The admixture was cooled to a temperature of −10° C. 34.5 g of boron tribromide was dropwise added to the cooled admixture. After the admixture underwent a reaction at a temperature of −5° C. or less for 20 minutes, an aqueous solution of sodium carbonate was dropwise added thereto until neutralization was reached. The neutralized solution was transferred to a separating funnel and it was washed with water. After the oil phase was separated, the solvent was removed under reduced pressure. The residue was recrystallized from acetonitrile to obtain 45.2 g of the compound 8.

Step 7: Synthesis of the illustrative compoune (4)

45.2 g of the compound 8 which had been prepared in Step 6 was added to 600 ml of acetonitrile. To the admixture was dropwise added 100 ml of chloroform solution containing 20.2 g of 1-phenyltetrazolyl-5-sulfonyl chloride at room temperature (25° C.). To the reaction solution was added ethyl acetate. The solution was transferred to a separating funnel and it was washed with water. After the oil phase was separated, the solvent was distilled off. The residue was recrystallized from a mixed solvent of hexane and ethyl acetate to obtain 45.3 g of the desired illustrative compound (4). The melting point thereof was 201°-202° C.

Synthesis (2): Synthesis of illustrative compound (33)

The illustrative compound (33) was prepared by the following synthesis:

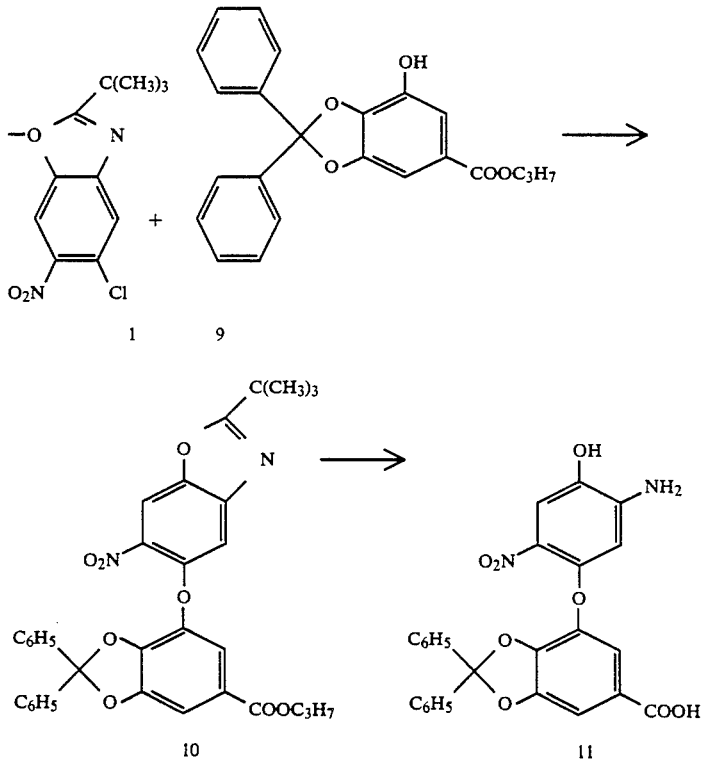

-continued
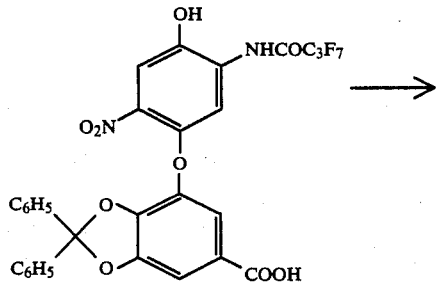
12
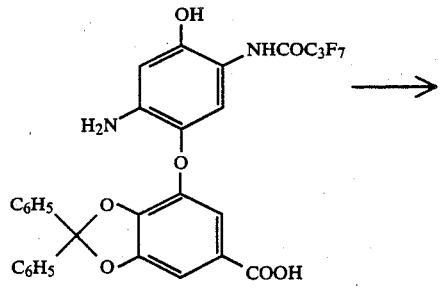
13
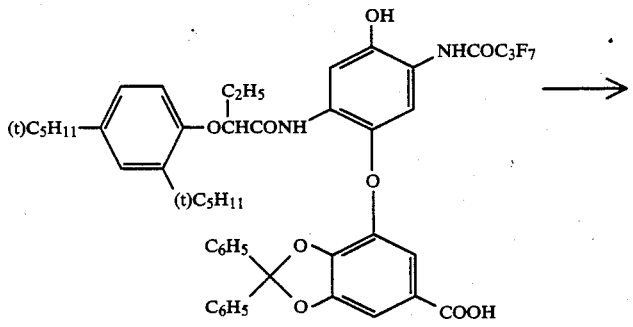
14
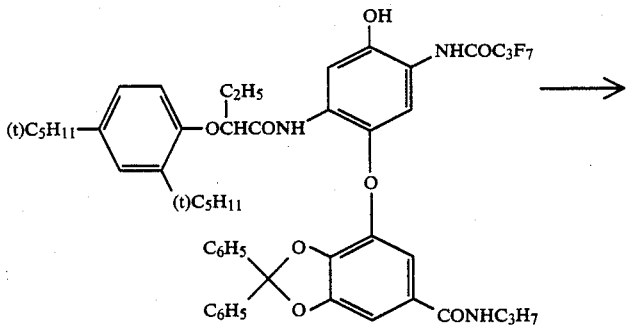
15

-continued

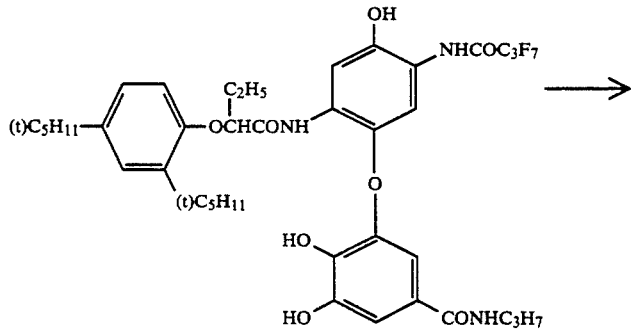

16

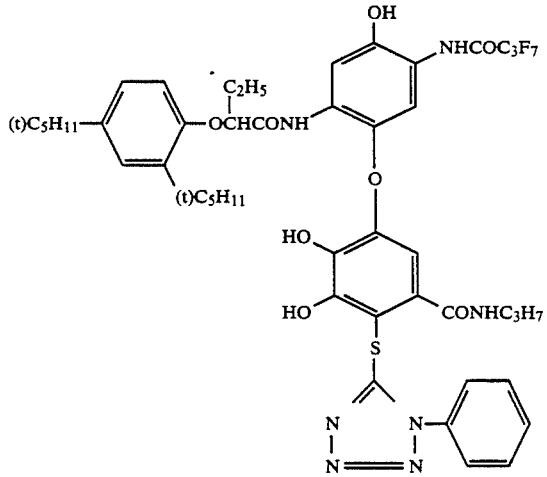

Compound (33)

Step 1: Synthesis of intermediate compound 10

147.7 g of the compound 9 (which had been prepared in the same manner as described in J. Am. Chem. Soc., 81, 4606 (1959)), 24.6 g of potassium hydroxide and 15 ml of water were added to 1 l of toluene. The admixture was heated under reflex for 1 hour. From the reaction solution were distilled off water and toluene as euteric mixture. To the residue were added 500 ml of N,N-dimethylformamide, 70 g of the compound 1, 0.5 g of cuprous chloride and the solution underwent a reaction at a temperature of 120° C for 4 hours. After the reaction solution was allowed to cool down to room temperature, 12 ml of hydrochloric acid, 150 ml of water and 500 ml of methanol were added thereto. The crystals thus precipitated were filtered off to obtain 120 g of the compound 10.

Step 2: Synthesis of intermediate compound 11

55.9 g of the compound 10 which had been prepared in Step 1 was added to a mixed solvent of 300 ml of ethanol and 100 ml of water. The admixture was then purged by bubbling with nitrogen gas. 31.4 g of potassium hydroxide was added to the solution and then heated under reflux for 6 hours. The solution thus refluxed was allowed to cool down to room temperature and mixed with hydrochloric acid until neutralization was reached. 500 ml of ethyl acetate was added to the solution thus neutralized, and the solution was transferred to a separating funnel. The solution was washed with water. After the oil phase was separated, the solvent was removed under reduced pressure. All the residue (46.2 g) was used in the subsequent step.

Step 3: Synthesis of intermediate compound 12

46.2 g of the compound 11 which had been prepared in Step 2 was dissolved in 500 ml of ethyl acetate. 47.3 g of anhydrous heptafluorobutanoic acid was added dropwise to the solution at room temperature. After the solution underwent a reaction at room temperature for 40 minutes, the reaction solution was mixed with an aqueous solution of sodium carbonate until neutralization was reached. The reaction solution was then transferred to a separating funnel where the oil phase was separated and washed with water. After the oil phase was separated, the solvent was removed under reduced pressure. Chloroform was added to the residue so that crystals precipitated. The crystals thus precipitated were filtered off, and the filtrate was then concentrated to obtain 52.5 g of the compound 12 which was all used in the subsequent step.

Step 4: Synthesis of intermediate compound 13

52.5 g of the compound 12 which had been prepared in step 3, 53 g of reduced iron, 3 g of ammonium chloride, and 3 ml of acetic acid were added to a mixed solvent of 280 ml of isopropanol and 40 ml of water. The admixture was heated under reflux for 1 hour. While the solution thus refluxed was hot, it was filtered. the filtrate was concentrated under reduced pressure until crystals precipitated. The filtrate thus concentrated was cooled. The crystals were filtered off to obtain 45.2 g of the compound 13.

Step 5: Synthesis of intermediate compound 14

45.2 g of the compound 13 was added to 500 ml of acetonitrile. 28.3 g of 2-(2,4-di-t-amylphenoxy)butanoyl chloride was added dropwise to the admixture while it was heated under reflux. After the mixture underwent a reaction under reflux for 30 minutes, it was allowed to cool down to room temperature. 500 ml of ethyl acetate was added to the reaction solution. The reaction solution was then washed with water. After the oil phase was separated, the solvent was removed under reduced pressure. The residue was recrystallized from ethyl acetate and n-hexane to obtain 56.7 g of the compound 14.

Step 6: Synthesis of intermediate compound 15

56.7 g of the compound 14 which had been prepared in Step 5 was added to a mixed solvent of 250 ml of tetrahydrofuran, 250 ml of acetonitrile and 10 ml of N,N-dimethylformamide. To the admixture was dropwise added 42.4 g of thionyl chloride at room temperature. After the solution underwent a reaction for 30 minutes, it was cooled down to 10° C. To the solution thus cooled was dropwise added 67.7 g of propylamine while keeping the temperature of the solution at 0° C. or less. After the solution was underwent a reaction at a temperature of 0° C. or less for 30 minutes, ethyl acetate was added thereto. The admixture was washed with water. After the oil phase was separated, the solvent was removed under reduced pressure. The residue was recrystallized from a mixed solvent of ethyl acetate and hexane to obtain 45.2 g of the compound 15.

Step 7: Synthesis of intermediate compound 16

45.2 g of the compound 15 which had been prepared in Step 6 was added to a mixed solvent of 300 ml of ethanol and 15 ml of hydrochloric acid. The admixture was heated under reflex for 1 hour. After the reaction solution was allowed to cool down to room temperature, 200 ml of water was added thereto. The crystals thus precipitated was filtered off to obtain 28.6 g of the compound 16.

Step 8: Synthesis of the illustrative compound (33)

28.6 g of the compound 16 which had been prepared in Step 7 was added to 600 ml of tetrahydrofuran. After the admixture was cooled down to −10° C., 4.6 g of aluminum chloride was added thereto. To the solution was dropwise added 60 ml of dichloromethane solution containing 8.8 g of 1-phenyltetrazolyl-5-sulfonyl chloride. After the solution underwent a reaction at a temperature of −10° C. for 30 minutes, ethyl acetate and water was added thereto. The reaction solution was trnsferred to a separating funnel where the oil phase was separated and washed with water. After the oil phase was separated, the solvent was removed under reduced pressure. The residue was recrystallized from a mixed solvent of hexane and ethanol to obtain 24.9 g of the desired illustrative compound (33). The melting point thereof was 197°-202° C.

Synthesis (3): Synthesis of illustrative compound (22)

The illustrative compound (22) was prepared by the following synthesis:

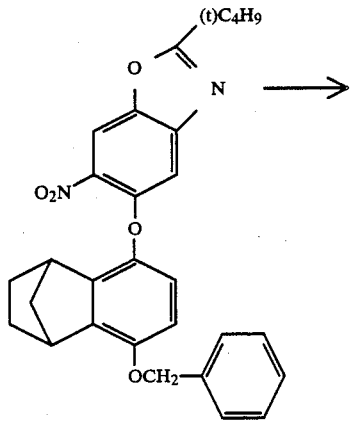

17

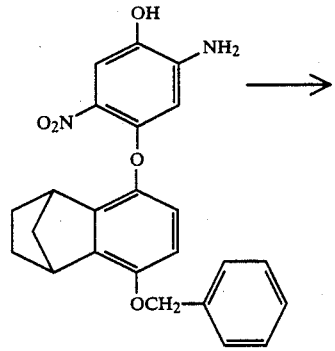

18

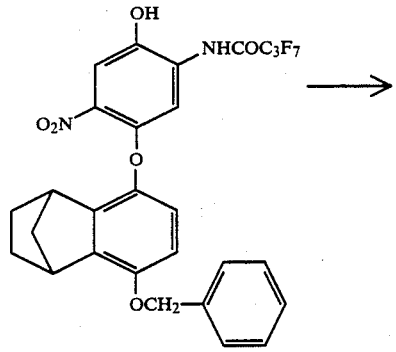

19

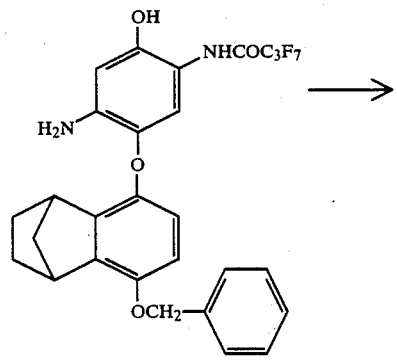

20

-continued

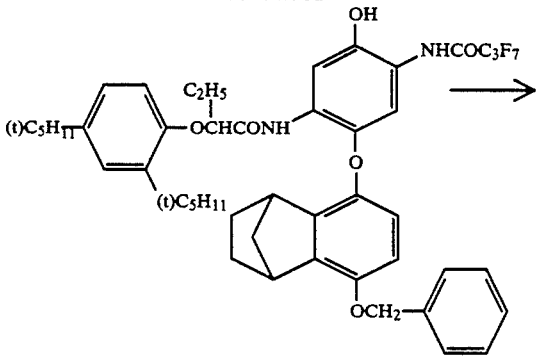

21

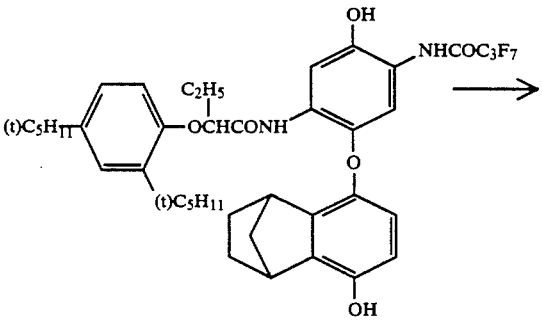

22

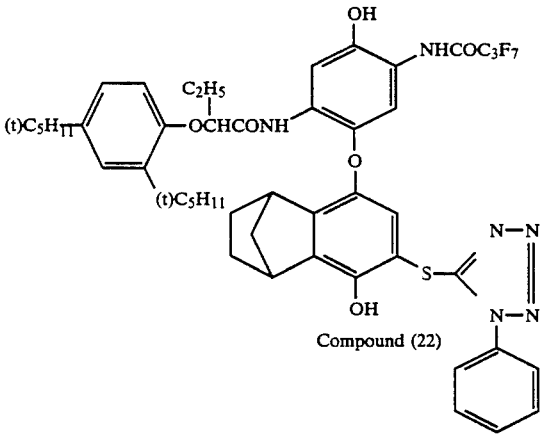

Compound (22)

Step 1: Synthesis of intermediate compound 18

34.8 g of the compound 17 was added to a mixed solvent of 300 ml of ethanol and 100 ml of water. The admixture was then purged by bubbling with nitrogen gas. 23.7 g of potassium hydroxide was added to the solution and then heated under reflux for 6 hours. The solution thus refluxed was allowed to cool down to room temperature and mixed with hydrochloric acid until neutralization was reached. 500 ml of ethyl acetate was added to the solution thus neutralized, and the resulting product was transferred to a separating funnel. The product was washed with water. After the oil phase was separated, the solvent was removed under reduced pressure. All the resisue (30.1 g) was used in the subsequent step.

Step 2: Synthesis of intermediate compound 19

30.1 g of the compound 18 which had been prepared in Step 1 was dissolved in 250 ml of ethyl acetate. 35.4 g of anhydrous heptafluorobutanoic acid was added dropwise to the solution at room temperature. After the solution underwent a reaction at room temperature for 40 minutes, the reaction solution was mixed with an aqueous solution of sodium carbonate until neutralization was reached. The reaction solution was then transferred to a separating funnel where the oil phase was separated and washed with water. After the oil phase was separated, the solvent was removed under reduced pressure. Chloroform was added to the residue so that crystals precipitated. The crystals thus precipitated were filtered off, and the filtrate was then concentrated to obtain 44.1 g of the compound 19 which was all used in the subsequent step.

Step 3: Synthesis of intermediate compound 20

44.1 g of the compound 19 which had been prepared in Step 2, 32 g of reduced iron, 3 g of ammonium chloride, and 3 ml of acetic acid were added to a mixed solvent of 150 ml of isopropanol and 50 ml of water. The admixture was heated under reflux for 3 hours. While the solution thus refluxed was hot, it was filtered. The filtrate was concentrated under reduced pressure until crystals precipitated. The filtrate thus concentrated was cooled. The crystals were filtered off to obtain 38 g of the compound 20.

Step 4: Synthesis of intermediate compound 21

38 g of the compound 20 was added to 300 ml of acetonitrile. 23.1 g of 2-(2,4-di-t-amylphenoxy)butanoyl chloride was added dropwise to the mixture while it was heated under reflux. After the mixture underwent a reaction under reflux for 3 hours, it was allowed to cool down to room temperature. 500 ml of ethyl acetate was added to the reaction solution. The reaction solution was then washed with water. After the oil phase was separated, the solvent was removed under reduced pressure. The residue was recrystallized from ethyl acetate and acetonitrile to obtain 43.8 g of the compound 21.

Step 5: Synthesis of intermediate compound 22

43.8 g of the compound 21 which had been prepared in the previous step was added to 300 ml of dichloromethane. The admixture was cooled to a temperature of 0° C. 24.7 g of boron tribromide was added dropwise to the admixture thus cooled. After the admixture underwent a reaction at a temperature of 0° C. for 2 hours, the reaction solution was gradually heated to a temperature of 5° C. After the reaction solution underwent a reaction at a temperature of 5° C. for 1 hour, a saturated aqueous solution of sodium hydrogen-carbonate was added dropwise thereto until neutralization was reached. The solution thus neutralized was transferred to a separating funnel where the oil phase was separated and washed with water. The resulting solution was washed with dilute hydrochloric acid and then with water until neutralization was reached. After the oil phase was separated, the residue was concentrated to obtain 36 g of the compound 22.

Step 6: Synthesis of the illustrative compound (22)

8.3 g of 5-mercaptophenyltetrazole and 6.4 g of sulfuryl chloride were reacted with each other in dichloromethane at a temperature of 5° C. for 1 hour. The product was concentrated under reduced pressure. 10 ml of dichloromethane was added to the residue. The admixture was added dropwise at room temperature to a solution which had been prepared by dissolving 36 g of the compound 22 obtained in the previous step in 200 ml of acetonitrile. After the admixture underwent a reaction at room temperature for 2 hours, it was heated to a temperature of 60° C and underwent a reaction for 1 hour. After the reaction solution was cooled to room temperature, 500 ml of ethyl acetate was added thereto. The solution was transferred to a separating funnel where it was washed with water until neutralization was reached. After the oil phase was separated, the solvent was removed under reduced pressure. The residue was recrystallized from a mixed solvent of ethyl acetate and hexane to obtain 28.5 g of the desired illustrative compound (22).

The compounds of the present invention can be used in the form of mixtures and the same compound can be used in a layer other than the most sensitive layer.

The compound of the present invention is added to the most sensitive unit layer of photosensitive silver halide emulsion layers of a silver halide color photographic material, and the amount to be added per mol of a silver halide in the most sensitive unit layer is at most 1 mol%. If the amount is over that, troubles such as desensitization and soft gradation will become eminent. The amount to be added per mol of a silver halide is preferably 0.001 to 0.5 mol%, more preferably 0.005 to 0.2 mol%, and most preferably 0.005 to 0.1 mol%.

Although the reason is nuclear why the compound of the present invention added in the range stated above exhibits a favorable result, the reason can be considered as follows:

Japanese Patent Application No. 33059/84 (corresponding to European Patent 157,146A2) discloses compounds represented by the following general formula:

A-RED-PUG wherein A represents a coupler residue that will couple with the oxidized product of a developing agent to release RED-PUG, RED represents a group that, after separating from A, will cause an oxidation-reduction reaction with the oxidized product of the developing agent to release PUG, and PUG represents a group that, after splitting from RED, will exhibit substantially a photographic effect.

This compound can release PUG only when RED-PUG (PUG means herein a development inhibitor) released by the reaction with the oxidized product of a developing agent has been made into OX-PUG (OX means herein the oxidized product of RED) by another molecule of the oxidized product of the developer agent. Further, it is attacked nucleophilically by the hydroxide ion ($OH^{\ominus}$), sulfurous acid ion, hydroxyamine, etc. present in the developer to release PUG. Therefore, it is considered that the process of the first oxidation-reduction reaction (RED-PUG→OX-PUG), in comparison to a conventional DIR compounds, will depend largely on the amount of silver of a silver halide that will determine the production rate and production amount of the oxidized product of a developing agent, and because sulfurous acid ions, hydroxide ions, hydroxylamine, etc. that will determine the releasing rate will react with the oxidized product of the developing agent and will be consumed, the second process of the nucleophilic reaction (OX-PUG+Nu→OX-Nu+PUG, Nu meaning herein a nucleophilic agent) will also depend on the amount of the silver mentioned. Therefore, so long as the amount of the compound of the present invention for the silver halide in the unit layer containing said compound falls in said range, it can be expected that a remarkable improvement in photographic performance is attained.

The present multi-layer photographic material has at least each of one red sensitive emulsion layer, one green sensitive emulsion layer, and one blue sensitive emulsion layer on a support. The order of the layers can be selected as desired. Although generally, the red sensitive emulsion layer contains a cyan forming coupler, the green sensitive emulsion layer contains a magenta forming coupler and the blue sensitive emulsion layer contains a yellow forming coupler, the combination can be changed.

In addition to a compound of the general formula (I), a color coupler, that is, a compound that can develop a color by oxidation coupling with an aromatic primary amine developing agent (e.g., a phenylenediamine derivative, a aminophenol derivative, etc.) in color development can be used in the same photographic material prepared in accordance with the present invention or another photographic emulsion layer or light-insensitive layer.

The silver halide multi-layer color photographic material that uses the present invention employs generally yellow, magenta and cyan forming couplers.

Useful color couplers are couplers capable of forming a cyan, magenta and yellow dye, and typical examples of them are naphthol or phenol type compounds, pyrazolone or pyrazoloazole type compounds and open chain or heterocyclic ketomethylene compounds. Examples of these cyan, magenta and yellow couplers are described in patents cited in *Research disclosure* 17643 (Dec., 1978), VII-D and *Research Disclosure* 18717 (Nov., 1979).

The color coupler contained in the photosensitive material is preferably one having a ballast group or one capable of becoming fast to diffusion when polymerized. 2-equivalent color couplers whose coupling position is substituted by a coupling off group are more advantageous than 4-equivalent color couplers whose coupling active position is substituted by a hydrogen atom in that they need a smaller applied amount of silver and provide a higher sensitivity. Couplers whose developed dyes are suitably diffusible or couplers capable of releasing a development accelerator can also be used.

As typical yellow couplers that can be used in the invention can be mentioned oleophilic acylacetamido type couplers.

Examples thereof are described in U.S. Pat. Nos. 2,407,210, 2,875,057, and 3,265,506. Typical examples of 2-equivalent yellow couplers are oxygen atom splitting-off type yellow couplers described in U.S. Pat. Nos. 3,408,194, 3,447,928, 3,993,501, and 4,022,620, and nitrogen atom splitting-off type yellow couplers described in Japanese Patent Publication No. 10739/83, U.S. Pat. Nos. 4,401,752, and 4,326,024, *Research Disclosure* 18053 (Apr., 1979), British Patent 1,425,020, West German Patent Application (OLS) Nos. 2,219,917, 2,261,361, 2,329,587, and 2,433,812, etc. α-pivaloylacetanilide type couplers are excellent in fastness, in particular light-fastness, of the color developed dye, while α-benzoylacetanilide type couplers can provide a higher color density.

Examples of magenta couplers that can be used in combination with the present invention are oleophilic indazolone type or cyanoacetyl type pyrazolone couplers, preferably 5-pyrazolone type couplers and oleophilic pyrazoloazole type couplers such as pyrazolotriazole type couplers. Of the 5-pyrazolone type couplers, couplers where the 3-position is substituted by an arylamino group or acylamino group are preferred in view of color density and hue of the color developed dye, and typical examples thereof are described in U.S. Pat. Nos. 2,311,082, 2,343,703, 2,600,788, 2,908,573, 3,062,653, 3,152,896, and 3,936,015. As splitting-off groups of 2-equivalent 5-pyrazolone type couplers are particularly preferred nitrogen atom splitting-off groups described in U.S. Pat. No. 4,310,619 and arylthio groups described in U.S. Pat. No. 4,351,897. 5-Pyrazolone type couplers having a ballast group described in European Patent 73,636 can provide a high color density.

As pyrazoloazole type couplers can be mentioned pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in *Research Disclosure* 24220 (June, 1984), and pyrazolopyrazoles described in *Research Disclosure* 24230 (June, 1984). Imidazol[1,2-b]pyrazoles described in European Patent 119,741 are preferred in view of light-fastness and lowness in yellow secondary absorption of the color developed dye, and pyrazolo[1,5-b][1,2,4]triazoles described in European Patent 119,860 are particularly preferred.

Cyan couplers that can be used in combination with the present invention include oleophilic naphthol type and phenol type couplers, and typical examples thereof are naphthol type couplers described in U.S. Pat. No. 2,474,293, and preferably 2-equivalent naphthol type couplers of the oxygen atom splitting-off type described in U.S. Pat. Nos. 4,052,212, 4,146,396, 4,228,233 and 4,296,200. Examples of phenol type couplers are described in U.S. Pat. Nos. 2,369,929, 2,801,171, 2,772,162, and 2,895,826. Cyan couplers fast to humidity and temperature are used preferably in the present invention, and typical examples thereof are phenol type cyan couplers having an ethyl group or higher alkyl group in the metaposition of the phenol nucleus, described in U.S. Pat. No. 3,772,002, 2,5-diacylaminosubstituted phenol type couplers described in U.S. Pat. Nos. 2,772,162, 3,758,308, 4,126,396, 4,334,011, and 4,327,173, West German Patent Application (OLS) No. 3,329,729, and Japanese Patent Application No. 42671/83 (corresponding to Japanese Patent Application (OPI) No. 166956/84) and phenol type couplers having a phenylureido group at the 2-position, and an acylamino group at the 5-position described in U.S. Pat. Nos. 3,446,622, 4,333,999, 4,451,559, and 4,427,767, etc. To correct undesired absorption of the short wave range inherent to a dye produced from a magenta or cyan coupler, preferably a colored coupler is additionally used in a color photographic material for photographing. Typical examples thereof are yellow-colored magenta couplers described in U.S. Pat. No. 4,163,670, Japanese Patent Publication No. 39413/82, magenta-colored cyan couplers described in U.S. Pat. Nos. 4,004,929, and 4,138,258, British Patent 1,146,368, etc.

Couplers, the color developed dyes having suitable diffusibility, can additionally be used to improve graininess. As examples of such couplers can be mentioned magenta couplers described in U.S. Pat. No. 4,366,237 and British Patent 2,125,570 and yellow, magenta and cyan couplers described in European Patent 96,570 and West German Patent Application (OLS) No. 3,234,533.

The dye forming couplers and the special couplers mentioned above may form a dimer, trimer or higher polymer. Typical examples of polymerized dye forming couplers are described in U.S. Pat. Nos. 3,451,820, and 4,080,211. Examples of polymerized magenta couplers are described in British Patent 2,102,173 and U.S. Patent 4,367,282.

These couplers may be 4-equivalent or 2-equivalent to a silver ion.

In addition to DIR couplers, colorless DIR coupling compounds, the coupling reactive product being colorless and capable of releasing a development inhibitor, can also be contained.

To satisfy properties necessary to a photographic material, two or more of the couplers mentioned above can be used in the same layer of a photographic layer or the same compound can be introduced in two or more layers.

As a method of introducing the compound of the present invention and the coupler, which can be additionally used, into a silver halide emulsion layer can be used a known method, for example, the method described in U.S. Pat. No. 2,322,027. For instance, they are dissolved in a phthalic acid alkyl ester (e.g., dibutyl phthalate, dioctyl phthalate, etc.), a phosphate (e.g., diphenyl phosphate, triphenyl phosphate, tricresyl phosphate, and diocylbutyl phosphate), a citrate (e.g., tributyl acetylcitrate), a benzoate (e.g., octyl benzoate), an alkylamide (e.g., diethyllaurylamide), a fatty acid ester (e.g., dibutoxyethyl succinate, diethyl azelate, etc.), a trimesic acid ester (e.g.,trimesic acid tributyl ester), or the like, or an organic solvent having a boiling point of 30 to 150° C, for example, a lower alkyl acetate such as ethyl acetate and butyl acetate, ethyl propionate, secondary butyl alcohol, methyl isobutyl ketone, 8-ethoxyethyl acetate, methyl cellosolve acetate, or the like, and then are dispersed in a hydrophilic colloid. The above high-boiling organic solvent and low-boiling organic solvent can be used as a mixture.

The dispersion method using a polymer described in Japanese Patent Publication No. 39853/76 and Japanese Patent Application (OPI) No. 59943/76 can also be used.

Couplers having an acidic group such as a carboxylic group and a sulfonic group are converted to an aqueous alkaline solution before being incorporated into a hydrophilic colloid.

As a binding material or a protective colloid that can be used in the emulsion layer or the intermediate layer of the photographic material of the present invention, gelatin can be advantageously used, although other hydrophilic colloids can be used alone or in combination with gelatin.

In the present invention, gelatin that has been treated with either lime or an acid can be used. Details of the method of producing gelatin are described in The Macromolecular Chemistry of Gelatin by Arthur Veis, Academic Press (1964).

As a silver halide in a photographic emulsion layer of the photographic material used in the present invention can be used silver bromide, silver bromoiodide, silver chlorobromide, silver bromochloroiodide or silver chloride. A preferred silver halide is silver bromoiodide containing up to 15 mol% of silver iodide A particularly preferred silver halide is silver bromoiodide containing from 2 to 12 mol% of silver iodide The average grain size of the silver halide grains is not specified but preferably is up to 3 $\mu$. The average grain size is expressed in terms of the grain diameter when the grains are spherical or nearly spherical, or in terms of the average length of the edges based on the projected area when the grains are cubic.

The grain size distribution may be narrow or wide.

The silver halide grains may be regularly shaped crystals, that is, may have a cubic, or octahedral shape or may be irregularly shaped crystals, that is, amy be spherical, tabular or the like or they may be a composite of these. The silver halide grains may also be made up of a mixture of grains having various shapes of crystals An emulsion can be used wherein silver halide grains whose grain diameter is five times as great as the thickness thereof occupy 50% or over of all the projected areas.

The silver halide grains may have different phases with respect to the inner part and the surface layer thereof. Grains may be used wherein a latent image is formed mainly on the surfaces or a latent image is formed mainly within grains.

The photographic emulsions used in the present invention may be prepared according to the methods described in "Chimie et Physque Photographique" by P. Glafkedes, Paul Montel (1966), "Making and Coating Photographic Emulsion", by V. L. Zelikman et al., The Focal Press (1964), etc. That is, any one of the acid, neutral, ammonia methods, etc. can be used, and to react a soluble silver salt and a soluble halogen salt, the single jet method, double jet method, or a combination of these methods can be used.

The so-called reverse mixing method wherein grains are formed in the presence of excess silver ions can also be used. As one type of the double jet method can be used the so-called controlled double jet method wherein the pAg in the liquid phase in which a silver halide is to be formed is kept constant.

According to this method a silver halide emulsion can be obtained wherein the crystal form is regular and the grain size is near uniform.

A mixture of separately prepared two or more silver halide emulsions can be used.

In the course of the formation of silver halide grains or physical-ripening, a cadmium salt, zinc salt, lead salt, thallium salt, iridium salt or a complex salt thereof, a rhodium salt or a complex salt thereof, an iron salt or an iron complex salt, etc. may coexist.

The silver halide emulsion generally is chemically sensitized. To chemically sensitize a silver halide emulsion, the methods described by H. Frieser, in "Die Grundlagen der photographischen Prozesse mit Silberhalogeniden", Akademische Verlagsgesellschaft (1968), pages 675 to 734 can be used.

That is, sulfur sensitization that uses a sulfur-containing compound (e.g., a thiosulfate, a thiourea, a mercapto compound, and a rhodanine) capable of reacting with activated gelatin or silver, reduction sensitization that uses a reducing substance (e.g., a stanous salt, an amine, a hydrazine derivative, formamidine sulfinate, and a silane compound), or noble metal sensitization that uses a noble metal compound (e.g., a gold complex salt, a complex salt of a metal in Group VIII of the Periodic Table such as Platinum, iridium, palladium, etc.) or a combination thereof can be carried out.

The photographic emulsion used in the present invention can contain various compounds for the purpose of stabilizing the photographic performance or of preventing the fogging of the photographic material during the production, storage or photographic processing thereof. That is, various compounds known as an antifoggant or stabilizer can be added such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles, (particularly 1-phenyl-5-mercaptotetrazole); mercaptopyrimizines; mercaptotriazines; thioketo compounds such as oxadrinthion; azaindenes (e.g., triazaindenes, tetraazaindenes (particularly 4-hydroxysubstituted (1,3,3a,7)-tetraazandenes), pentaazaindenes; and benzenthiosulfonic acid, benzensulfinic acid, benzensulfonic acid amides, etc.

The photographic emulsion layer or other hydrophilic colloid layers of the photosensitive material prepared by using the present invention can contain a coating aid and various surface active agents for various purposes for example for the purpose of rendering them antistatic, or for the purpose of improvement in slipperiness, emulsifying and dispersing, adhesion prevention, and photographic properties such as acceleration of development, contrasting or sensitization.

The photographic emulsion layer of the photosensitive material according to the present invention can contain, for the purpose of increasing the sensitivity or contrast or accelerating the development, for example, polyalkylene oxides or their derivatives such as their ethers, esters and amines, thioether compounds, thiomorpholines, quaternary ammonium salt compounds, urethane derivatives, urea derivatives, imidazole derivatives, 3-pyrazolidones, etc.

In the photographic material used in the present invention, the photographic emulsion layer or other hydrophilic colloid layer can contain, for the purpose of improving dimension stability, a dispersion of a water-soluble or hardly water-soluble synthetic polymer. For example, such polymers made up of: an alkyl acrylate, alkyl mathacrylate, alkoxyalkyl acrylate, alkoxyalkyl methacrylate, glycidyl acrylate, glycidyl acrylate, glycidyl methacrylate, acrylamide, methacrylamide, vinyl ester (e.g., vinyl acetate), acrylnitrile, olefin, or styrene, or a mixture of these or its mixture with acrylic acid, methacrylic acid, $\alpha,\oplus$-unsaturated dicarboxylic acid, hydroxyalkyl acrylate, hydroxyalkyl methacrylate, sulfoalkyl acrylate, sulfoalkyl methacrylate, styrene sulfonic acid or the like.

The photographic emulsion used in the present invention may be spectrally sensitized with a methine dye or other means. Dyes that can be used include a cyanine dye, merocyanine dye, complex cyanine dye, complex merocyanine dye, holopolar cyanine dye, hemicyanine, styryl dye and hemioxonol dye. Particularly useful dyes include a cyanine dye, merocyanine dye and complex merocyanine dye. Any one of nuclei generally used for cyanine dyes as basic heterocyclic nuclei can be applied to these dyes. Examples of nuclei include a pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc; a nucleus having the nucleus mentioned that is condensed to a cycloaliphatic hydrocarbon ring; and a nucleus having the nucleus mentioned that is condensed to an aromatic hydrocarbon ring, that is, an indolenin nucleus, benzindolenin nucleus, indole nucleus, benzoxazole nucleus, naphthoxazole nucleus, benzothiazole nucleus, naphthothiazole nucleus, benzoselenazole nucleus, benzimidazole nucleus, quinoline nucleus, etc. These nuclei may have a substituent on the carbon atom.

In merocyanine dyes or complex merocyanine dyes, can be applied, as a nucleus having a ketomethylene structure, a 5- or 6-membered heterocyclic ring nucleus such as a pyrazoline-5-one nucleus, thiohydantoin nucleus, 2-thioxazolidine-2,4-dione nucleus, thiazolidine-2,4-dione nucleus, rhodanine nucleus, thiobarbituric acid nucleus, etc.

These sensitizing dyes can be used alone or as a mixture thereof, and in particular the mixture thereof is often used for the purpose of supersensitization.

In addition to the sensitizing dye, a dye having

In addition to the sensitizing dye, a dye having no spectral sensitization itself or a substance that does not substantially absorb visible light but has a supersensitization effect can be contained in the emulsion. For example, aminostyryl compounds substituted by a nitrogencontaining heterocyclic ring (e.g., those described in U.S. Pat. Nos. 2,933,390, and 3,635,721), an aromatic organic acid formaldehyde condensate (e.g., those described in U.S. Pat. No. 3,743,510), a cadmium salt, azaindene compound, etc. can be contained.

In the photographic material of the present invention, the photographic emulsion layer or other hydrophilic colloid layer can contain an inorganic or organic hardening agent. For example, chromium salts (chromium alum, chromium acetate, etc.), aldehydes (e.g., formaldehyde, glyoxal, glutaraldehyde, etc.), N-methylol compounds (e.g., methyloldimethylhydantoin, dimethylol urea, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halides (e.g., 2,4-dichloro-6-hydroxy-s-triazine), mucohalic acids (mucochloric acid, mucophenoxychloric acid, etc.) can be used alone or in the form of mixtures.

In the photographic material prepared in accordance with the present invention, when the hydrophilic colloid layer contains a dye, an ultraviolet light absorber, or the like, they may be mordanted with a cationic polymer or the like.

The photographic material prepared using the present invention may contain, as a color antifoggant, a hydroquinone derivative, aminophenol derivative, gallic acid derivative, ascorbic acid derivative, etc.

The photographic material prepared using the present invention may contain an ultraviolet light absorber in the hydrophilic colloid layer. Examples of ultraviolet light absorbers are benzotriazole compounds substituted by an aryl group (e.g., those described in U.S. Pat. No. 3,533,794), 4-thiazolidone compounds (e.g., those described in U.S. Pat. Nos. 3,314,794, and 3,352,618), benzophenone compounds (e.g., those described in Japanese Patent Application (OPI) No. 2784/71), cinnamic acid ester compounds (e.g., those described in U.S. Pat. Nos. 3,705,805, and 3,707,375), butadiene compounds (e.g., those described in U.S. Pat. No. 4,045,229) or benzoxazole compounds (e.g., U.S. Pat. No. 3,700,455). Ultraviolet light absorbing couplers (e.g., $\alpha$-naphthol type cyan dye forming couplers) or ultraviolet light absorbing polymers can also be used. These ultraviolet light absorbing agents may be mordanted in a particular layer.

In the photographic material prepared using the present invention, the hydrophilic colloid layer may contain, as a filter dye or for the purpose of prevention of irradiation or other purposes, water-soluble dyes. Such dyes include oxonol dyes, hemioxonol dyes, styryl dyes, merocyanine dyes, cyanine dyes and azo dyes. Inter alia, oxonol dyes, hemioxonol dyes and merocyanine dyes are useful.

In the practice of the present invention, the following known discoloration preventing agents can also additionally be used, and furhter the color image stabilizing agents used in the present invention can be used alone or in the form of a mixture. Known discoloration preventing agents include hydroquinone derivatives, gallic acid derivatives, p-alkoxyphenols, p-oxyphenols, and bisphenols.

In the photographic processing of the layer consisting of a photographic emulsion prepared using the present invention can be applied any one of known methods and known processing solutions as described in *Research Disclosure*, No. 176, pages 28–30. Although generally the processing temperature is 18 to 50° C, temperatures lower than 18° C. or higher than 50° C. can also be used.

The color developer generally consists of an aqueous alkaline solution containing a color developing agent. As a color developing agent use is made of known primary aromatic amine developing agents such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-ethyl-N-$\beta$-hydroxyethylaniline, 3-methyl-4-amino-N-ethyl-N-$\beta$-methanesulfoamidoethylaniline, 4-amino-3-methyl-N-ethyl-N-$\beta$-methoxyethylaniline, etc.).

Further those described in "Photographic Processing Chemistry" by F. A. Mason, Focal Press (1966), pages 226–229, U.S. Pat. Nos. 2,193,015, and 2,592,364, and Japanese Patent Application (OPI) No. 64933/73 can also be used.

The color developer can additionally contain a pH buffer such as an alkali metal sulfite, carbonate, borate or phosphate, and an antifoggant or a development inhibitor such as a bromide, an iodide, and an organic antifoggant. If required, a water softener, a preservative such as hydroxylamine, an organic solvent such as benzyl alcohol and diethylene glycol, a development accelerator such as a polyethylene glycol, a quaternary ammonium salt, and an amine, a dye forming coupler, a competing coupler, a fogging agent such as sodium boron hydride, an auxiliary developing agent such as 1-phenyl-3-pyrazolidone, a viscosity producer, a polycarboxylic acid type chelating agent and antioxidant.

After the color development, the photosensitive emulsion layer is generally bleached. Bleaching and fixing may be carried out simultaneously or separately. Examples of bleaching agents are compounds of polyvalent metals such as iron (III), cobalt (III), chromium (VI) and copper (II), peracids, quinones, and nitroso compounds.

For example, the following can be used: ferricyanides, dichromates, organic complex salts of iron (III) or cobalt (III) such as complex salts of aminopolycarboxylic acids for example 1,3-diamino-2-propanoltetraacetic acid, ethylenediaminetetraacetic acid and nitrilotriacetic acid, citric acid, tartaric acid and malic acid; persulfates and permanganates; and nitrosophenol. Potassium ferricyanide, sodium ethylenediaminetetraacetato ferrate and ammonium ethylenediaminetetraacetato ferrate are particularly useful. Iron (III) ethylenediaminetetraacetate complex salt is useful in an independent bleaching solution and also in a combined bleaching and fixing solution.

A fixing solution having a composition that is generally used can be used. As a fixing agent can be used a thiosulfate, or a thiocyanate or an organic sulfur compound known to have a fixing effect. The fixer may contain a water-soluble aluminium salt as a hardening agent.

After the fixing step or bleach-fixing step, though processing including washing, stabilizing, etc. is generally carried out, simple processing method such as only a washing step or a stabilizing processing step substantially without a washing step can be employed (see Japanese Patent Application (OPI) No. 8543/82).

Washing water used in the washing step can contain known additives if required. For example, chelating agents such as organic phospholic acids, inorganic phosphates, aminopolycarboxylic acids, etc., fungicides for preventing bacteria or algae from proliferating, hardering agents such as magnesium salts, aluminium salts, etc., surfactants for preventing drying load or uneven drying, and the like can be used. Further, compounds described in "Water Quality Criteria", by L. E. West, Phot. Sci. and Eng, Vol. 9, No. 6, pages 344–359 (1965), etc. can be used.

In the washing step, two or more tanks may be used if required and multi-stage countercurrent water washing (e.g., 2 to 9 stages) can be used to save water.

As a stabilizer used in the stabilizing step can be used a processing solution for stabilizing a dye image. For example, a solution with a pH of 3 to 6 and having a buffering effect or a solution containing an aldehyde (e.g., formaldehyde) can be used. In the stabilizer, if required, use is made of a brightening agent, a chelating agent, a fungicide, a hardening agent, a surfactant, etc.

The stabilizing step can use two or more tanks if required and multi-stage countercurrent stabilizing (e.g., 2 to 9 stages) can be used to save the stabilizer, with the washing step omitted.

The invention is now further described with reference to the following Examples, which are not intended to limit the scope of the invention.

EXAMPLE 1

A multi-layer color photosensitive material (101) consisting of layers having the compositions given below was formed on a transparent triacetylcellulose film support. The first layer: an antihalation layer comprising a gelatin layer that contained:

| | |
|---|---|
| Black colloidal silver | 0.15 g/m$^2$ |
| Ultraviolet absorbing agent U-1 | 0.08 g/m$^2$ |
| Ultraviolet absorbing agent U-2 | 0.12 g/m$^2$ |

The second layer: an intermediate layer comprising a gelatin layer that contained:

| | |
|---|---|
| 2,5-Di-t-pentadecylhydroquinone | 0.18 g/m$^2$ |
| Coupler C-1 | 0.11 g/m$^2$ |

The third layer: a first red-sensitive emulsion layer comprising a gelatin layer that contained:

| | |
|---|---|
| Silver bromoiodide (containing 4 mol % silver iodide and having an average grain size of 0.4 μ) | 1.2 g/m$^2$ |
| Sensitizing dye I | $1.4 \times 10^{-4}$ mol/mol silver |
| Sensitizing dye II | $0.4 \times 10^{-4}$ mol/mol silver |
| Sensitizing dye III | $5.6 \times 10^{-4}$ mol/mol silver |
| Sensitizing dye IV | $4.0 \times 10^{-4}$ mol/mol silver |
| Coupler C-2 | 0.051 mol/mol silver |

-continued

| | |
|---|---|
| Coupler C-3 | 0.0040 mol/mol silver |
| Coupler C-4 | 0.0040 mol/mol silver |

The fourth layer: a second red-sensitive emulsion layer comprising a gelatin layer that contained:

| | |
|---|---|
| Silver bromoiodide (containing 8 mol % silver iodide and having an average grain size of 0.7 μ) | 1.0 g/m$^2$ |
| Sensitizing dye I | $5.2 \times 10^{-5}$ mol/mol silver |
| Sensitizing dye II | $1.5 \times 10^{-5}$ mol/mol silver |
| Sensitizing dye III | $2.1 \times 10^{-4}$ mol/mol silver |
| Sensitizing dye IV | $1.5 \times 10^{-5}$ mol/mol silver |
| Coupler C-2 | 0.0068 mol/mol silver |
| Coupler C-5 | 0.0095 mol/mol silver |
| Coupler C-3 | 0.0048 mol/mol silver |

The fifth layer: an intermediate layer comprising a gelatin layer that contained:

| | |
|---|---|
| 2,5-Di-t-pentadecylhydroquinone | 0.08 g/m$^2$ |

The sixth layer: a first green-sensitive emulsion layer comprising a gelatin layer that contained:

| | |
|---|---|
| Silver bromoiodide (containing 4 mol % silver iodide and having an average grain size of 0.4 μ) | 0.80 g/m$^2$ |
| Sensitizing dye | $4.0 \times 10^{-4}$ mol/mol silver |
| Sensitizing dye VI | $3.0 \times 10^{-5}$ mol/mol silver |
| Sensitizing dye VII | $1.0 \times 10^{-4}$ mol/mol silver |
| Coupler C-6 | 0.077 mol/mol silver |
| Coupler C-7 | 0.022 mol/mol silver |
| Coupler C-8 | 0.0035 mol/mol silver |

The seventh layer: a second green-sensitive emulsion layer comprising a gelatin layer that contained:

| | |
|---|---|
| Silver bromoiodide (containing 8 mol % silver iodide and having an average grain size of 0.7 μ) | 0.85 g/m$^2$ |
| Sensitizing dye V | $2.7 \times 10^{-4}$ mol/mol silver |
| Sensitizing dye VI | $1.8 \times 10^{-5}$ mol/mol silver |
| Sensitizing dye VII | $7.5 \times 10^{-5}$ mol/mol silver |
| Coupler C-6 | 0.013 mol/mol silver |
| Coupler C-7 | 0.0020 mol/mol silver |
| Compound (I) of the present invention | 0.004 mol/mol silver |

The eight layer: a yellow filter layer comprising a gelatin layer that contains:

| | |
|---|---|
| Yellow colloidal silver | 0.08 g/m$^2$ |
| 2,5-Di-t-pentadecylhydroquinone | 0.090 g/m$^2$ |

The ninth layer: a first blue-sensitive emulsion layer comprising a gelatin layer that comprises:

| | |
|---|---|
| Silver bromoiodide emulsion (containing 5 mol % silver iodide and having an average grain size of 0.3 μ) | 0.37 g/m$^2$ |
| Sensitizing dye VIII | $4.4 \times 10^{-4}$ mol/mol silver |
| Coupler C-9 | 0.26 mol/mol silver |
| Coupler C-4 | 0.015 mol/mol silver |

The tenth layer: a second blue-sensitive emulsion layer comprising a gelatin layer that contained:

| | |
|---|---|
| Silver bromoiodide emulsion (containing 7 mol % silver iodide and having an average grain size of 0.9 μ) | 0.55 g/m² |
| Sensitizing dye VIII | $3.0 \times 10^{-4}$ mol/mol silver |
| Coupler C-9 | 0.057 mol/mol silver |

The eleventh layer: a first protective layer comprising a gelatin layer that contained:

| | |
|---|---|
| Ultraviolet light absorbing agent U-1 | 0.14 g/m² |
| Ultraviolet light absorbing agent U-2 | 0.22 g/m² |

The twelfth layer: a second protective layer comprising a gelatin layer that contained:

| | |
|---|---|
| Silver bromoiodide emulsion (containing 2 mol % silver iodide and having an average grain size of 0.07 μ) | 0.25 g/m² |
| Polymethacrylate particle (having a diameter of 1.5 μ) | 0.10 g/m² |

Gelatin hardening agent H-1 and a surface active agent were applied to each of the layers in addition to the above composition.

(Samples 102–115)

Samples 102–115 were prepared in the same way as for Sample 101, with the exception that the amount and type of the compound according to the present invention that had been added in the seventh layer in Sample 101 were changed as indicated in Table 1.

These Samples were subjected to exposure of 20 CMS using a C light source that was adjusted to 4800° K by a color temperature conversion filter, and the following color development was carried out at 38° C.

| | |
|---|---|
| Color development: | 3 min 15 sec. |
| Bleaching: | 6 min 30 sec. |
| Washing: | 2 min 10 sec. |
| Fixing: | 4 min 20 sec. |
| Washing: | 3 min 15 sec. |
| Stabilizing: | 1 min 05 sec. |

The compositions of the processing solutions used in the above steps were as follows:

| Color developing solution: | |
|---|---|
| Diethylenetriaminetetraacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| the balance of water to bring the total to an amount of 1,0 l | |
| pH | 10.0 |
| Bleaching solution: | |
| Ammonium ethylenediaminetetraacetato ferrate | 100.0 g |
| Disodium ethylenediaminetetraacetic acid | 10.0 g |
| Ammonium bromide | 150.0 g |
| Ammonium nitrate | 10.0 g |
| the balance of water to bring the total to an amount of 1.0 l | |
| pH | 6.0 |
| Fixing solution | |
| Disodium ethylenediaminetetraacetic acid | 1.0 g |
| Sodium sulfite | 4.0 g |
| Aqueous ammonium thiosulfate (70%) | 175.0 ml |
| Sodium bisulfite | 4.6 g |
| the balance of water to bring the total to an amount of 1.0 l | |
| pH | 6.6 |
| Stabilizer: | |
| Formalin (40%) | 2.0 ml |
| Polyoxyethylene-p-monononylphenylether (average degree of polymerization is about 10) | 0.3 g |
| the balance of water to bring the total to an amount of 1,0 l | |

Exposure using a pattern for determining MTF was also carried out, and the color developing process mentioned above was effected to determine the MTF value at 40 cycles/ 1 mm. The obtained results are given in Table 1.

From Table 1, it will be understood that if the added amount of the present compounds exceeds a certain amount, the development inhibiting effect is too high to remarkably lower sensitivity.

It can be understood that in comparison to the samples wherein a conventional DIR coupler was added to produce approximately the same sensitivity, the samples wherein the amount of the present invention was used are high in MTF value and excellent in sharpness.

TABLE 1

| Sample | Added compound | Added amount* | Relative Sensitivity** | M T F 40 cycle/mm |
|---|---|---|---|---|
| 101 (Present invention) | (1) | 0.4 | 100 | 0.41 |
| 102 (Present invention) | (1) | 0.8 | 95 | 0.42 |
| 103 (Comparative example) | (1) | 1.2 | 74 | 0.40 |
| 104 (Comparative example) | (1) | 2.4 | 56 | 0.39 |
| 105 (Present invention) | (4) | 0.3 | 102 | 0.43 |
| 106 (Present invention) | (4) | 0.6 | 98 | 0.44 |
| 107 (Comparative example) | (4) | 2.0 | 83 | 0.41 |
| 108 (Comparative example) | (4) | 5.0 | 66 | 0.40 |
| 109 (Present invention) | (30) | 0.4 | 100 | 0.43 |
| 110 (Present (invention | (30) | 0.6 | 98 | 0.45 |
| 111 (Present invention) | (30) | 0.8 | 95 | 0.45 |
| 112 (Comparative example) | (30) | 1.5 | 81 | 0.42 |
| 113 (Comparative example) | C-4 | 1.0 | 98 | 0.40 |
| 114 (Comparative example) | C-10 | 0.5 | 95 | 0.38 |
| 115 (Comparative example) | C-11 | 2.5 | 100 | 0.37 |

*In mol % based on the amount of silver halide in the sixth layer.
**Reciprocal of exposure giving a density of fog + 0.2; relative value assuming Sample 101 to be 100.

EXAMPLE 2

(Sample 201)

Sample 201 was prepared in the same manner as for Sample 101, with the exception that the compound (1) of the present invention added in the sixth layer of Sample 101 was removed, an intermediate layer was placed between the sixth layer and the seventh layer, and the silver halide emulsion in the sixth layer was to contain 4 mol% of silver iodide and to have an average grain size of 0.6 μ.

| The intermediate layer: | |
|---|---|
| Coupler C-6 | 0.08 g/m$^2$ |
| 2,5-Di-t-octylhydroquinone | 0.01 g/m$^2$ |
| Gelatin | 0.8 g/m$^2$ |

(Samples 202–207)

Samples 202–207 were prepared in the same manner as for Sample 201, with exception that comparative DIR couplers and compounds according to the present invention were added in amounts shown in Table 2 in the seventh layer of Sample 201.

TABLE 2

| | Added compound | Added amount* | Relative Sensitivity** | M T F value*** |
|---|---|---|---|---|
| 201 (Comparative example) | — | — | 110 | 0.42 |
| 202 (Comparative example) | (19) | 2.4 | 76 | 0.42 |
| 203 (Comparative example) | (19) | 1.6 | 87 | 0.43 |
| 204 (Present invention) | (19) | 0.8 | 105 | 0.46 |
| 205 (Comparative example) | (6) | 2.1 | 72 | 0.42 |
| 206 (Comparative example) | (6) | 1.4 | 85 | 0.44 |
| 207 (Present invention) | (6) | 0.7 | 100 | 0.47 |

*In mol % based on the mol amount of silver halide in the seventh layer.
**Reciprocal of exposure giving a density of fog + 0.2; relative value assuming Sample 207 to be 100.
***MTF value at 40 cycles/mm as in Example 1.

The sensitivity and MTF value of these Samples were determined in the same manner as in Example 1 and the results are given in Table 2.

It will be understood that the Examples according to the present invention are high in sensitivity and excellent in sharpness.

Structures of Compounds used in Examples

U-1

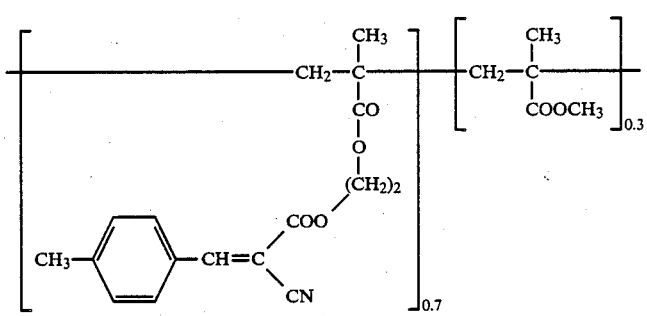

U-2

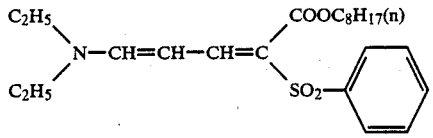

C-1

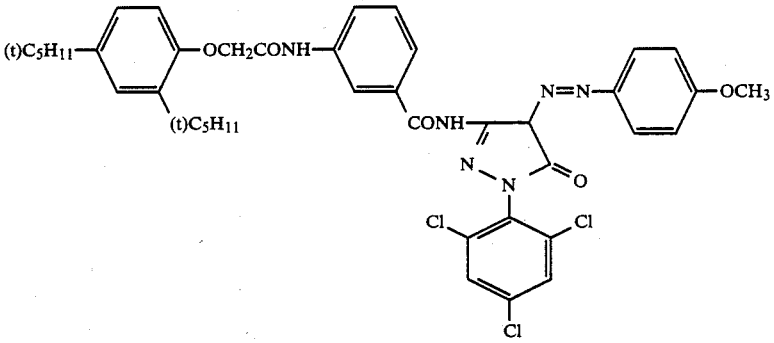

-continued
C-2
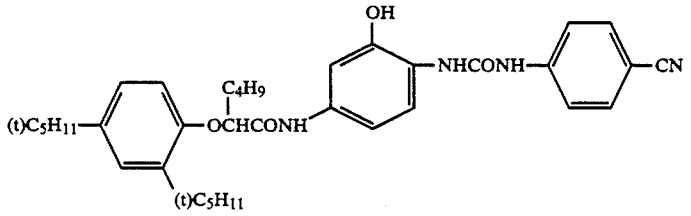
C-3
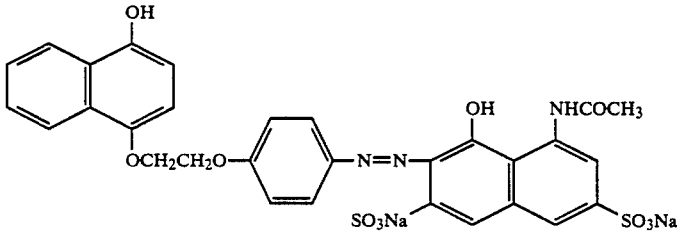
(Compound 49 disclosed in U.S. Pat. No. 4,477,563)
C-4
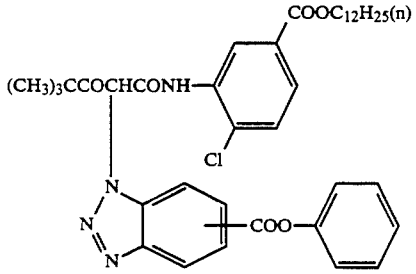
C-5
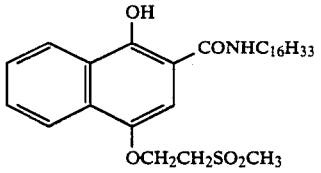
C-6
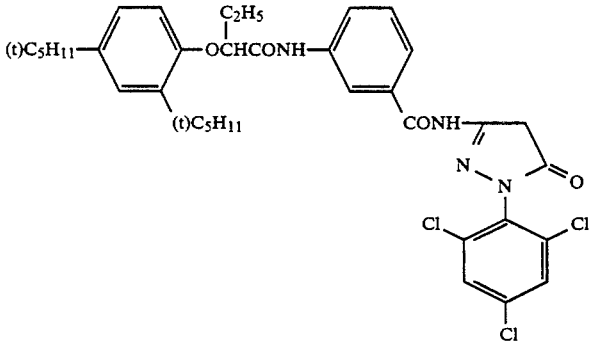
C-7
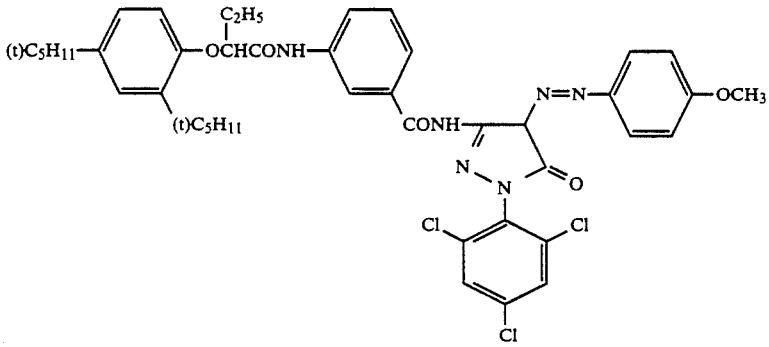

-continued
C-8
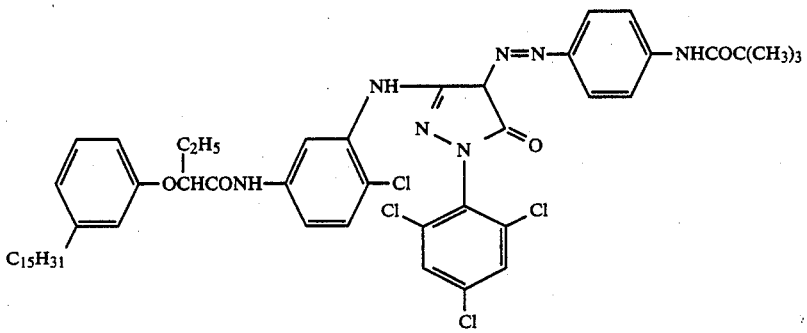
C-9
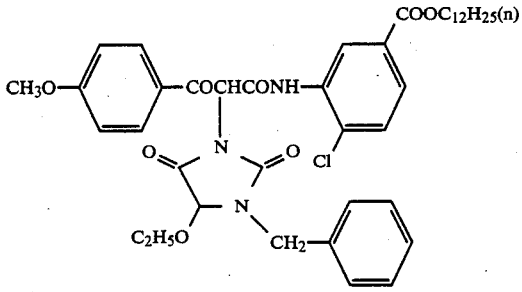
H-1
$CH_2{=}CH{-}SO_2{-}CH_2{-}CONH(CH_2)_2NHCO{-}CH_2{-}SO_2{-}CH{=}CH_2$
(Compound (7) disclosed in U.S. Pat. 4,095,934)
C-10
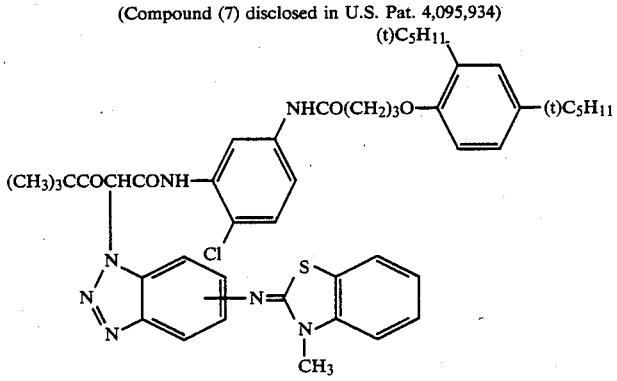
(Compound included in U.S. Pat. 3,227, 554, etc.)
C-11
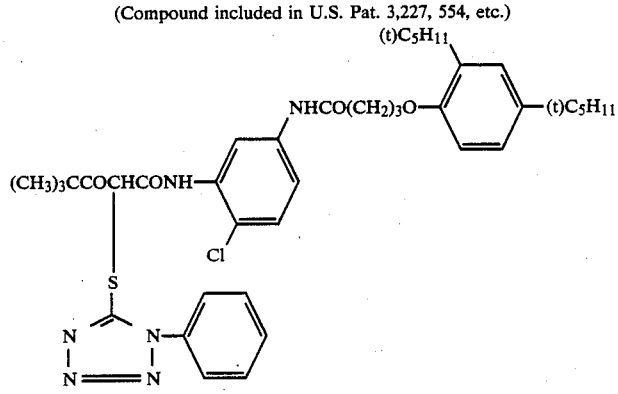
Sensitizing dyes
I
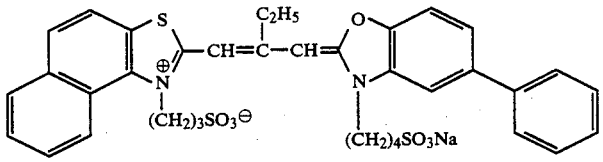

-continued

II

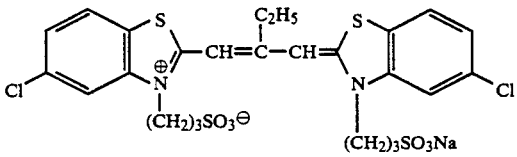

III

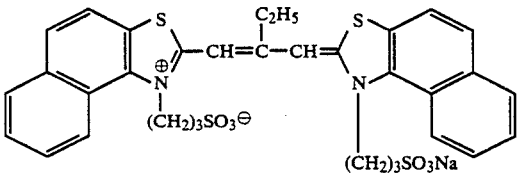

IV

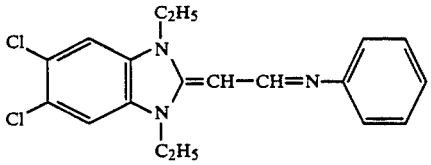

V

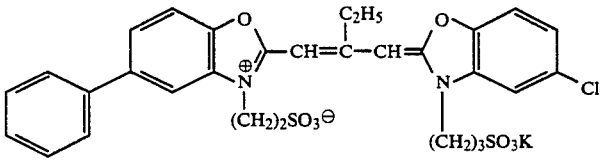

VI

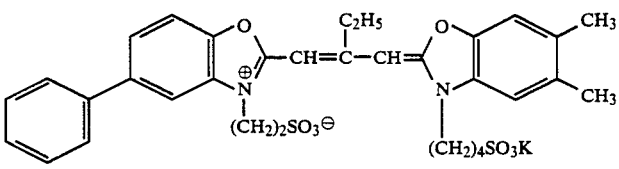

VII

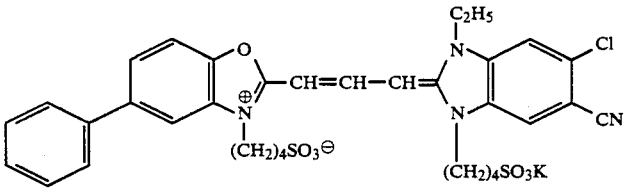

VIII

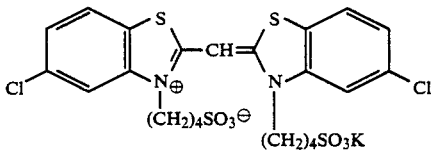

EXAMPLE 3

(Sample 301)

Sample 301 was prepared in the same manner as for Sample 101, with the exception that the compound (1) of the present invention added in the seventh layer of Sample 101 was removed, and the compound (13) was added in the fourth layer in an amount of 0.025 mol per mol of silver added in the fourth layer.

(Samples 302–307)

Samples 302–307 were prepared in the same manner as for Sample 301, with exception that compounds according to the present invention and comparative DIR couplers were added in amounts shown in Table 3 in the fourth layer of Sample 301, in place of the compound (13) of the present invention.

The sensitivity and MTF value of cyan image density of these Samples were determined in the same manner as in Example 1 and the results are given in Table 3.

It will be understood that the Examples according to the present invention are high in sensitivity and excellent in sharpness.

TABLE 3

| | | Added compound | Added amount* | Relative Sensitivity** | MTF value*** |
|---|---|---|---|---|---|
| 301 | (Comparative example) | (13) | 2.3 | 51 | 0.52 |
| 302 | (Comparative | (13) | 1.3 | 71 | 0.54 |

TABLE 3-continued

| | | Added compound | Added amount* | Relative Sensitivity** | MTF value*** |
|---|---|---|---|---|---|
| | example) | | | | |
| 303 | (Present invention) | (13) | 0.3 | 100 | 0.53 |
| 304 | (Present invention) | (33) | 0.1 | 102 | 0.54 |
| 305 | (Comparative example) | C-12 | 2.3 | 46 | 0.49 |
| 306 | (Comparative example) | C-12 | 1.3 | 69 | 0.49 |
| 307 | (Comparative example) | C-12 | 0.3 | 95 | 0.48 |

*In mol % based on the mol amount of silver halide in the fourth layer.
**Reciprocal of exposure giving a density of fog + 0.2; relative value assuming Sample 303 to be 100.
***MTF value of cyan image at 25 cycles/mm.
(C-12)
(Compound 4 as described in U.S. Pat. No. 4,482,629)

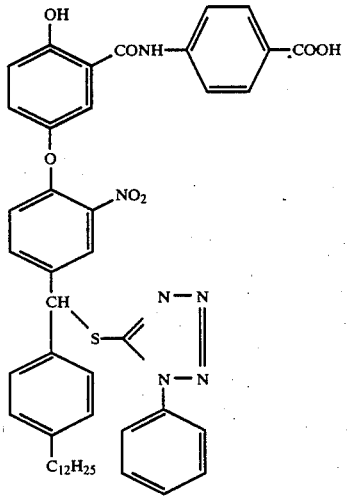

While the invention has been described in detail and with reference to specific embodiments thereof, it will be apparent to one skilled in the art that various changes modifications can be made therein without departing from the spirit & scope thereof.

What is claimed is:

1. A silver halide color photographic material including a blue-sensitive silver halide emulsion layer, a green-sensitive silver halide emulsion layer and a red-sensitive silver halide emulsion layer on a support, wherein at least one of the photosensitive layers comprises two or more unit layers having different sensitivities, and among all of said unit layers, the unit layer highest in sensitivity contains at least one of (a) a compound capable of producing, by the reaction of the compound with a developing agent oxidized product, a compound that can produce a development inhibitor or its precursor when oxidized, and (b) a compound capable of producing, by the reaction of the compound with a developing agent oxidized product, a precursor of a compound that can produce a development inhibitor or its precursor when oxidized, with the amount of said at least one of the compounds (a) and (b) being at most 1 mol% based on the amount of the silver halide in said unit layer highest in sensitivity.

2. A silver halide color photographic material of claim 1, wherein the compounds (a) capable of producing, by the reaction of the compound with a developing agent oxidized product, a compound that can produce a development inhibitor or its precursor when oxidized, and the compounds (b) capable of producing, by the reaction of the compound with a developing agent oxidized product, a precursor of a compound that can produce a development inhibitor or its precursor when oxidized comprise a compound having the general formula (I):

$$A\text{-}B\text{-}D \qquad (I)$$

wherein A represents a coupler residue that will split the linkage between A and B by the reaction with a developing agent oxidized product, B represents a group that will split the linkage between B and D when the linkage with A is split and then B is oxidized or its precursor is oxidized, and D represents a development inhibitor or its precursor.

3. A silver halide color photographic material of claim 2, wherein B in the general formula (I) represents the compound of the general formula (B-1):

$$*\text{—}(B_1)_v\text{—}\underset{\underset{(B_2)_w}{|}}{RED}\text{—}** \qquad (B\text{-}1)$$

wherein the mark * indicates the position to be attached to A and the mark ** indicates the position to be attached to D, $B_1$ represents a joining group that will split from RED after the linkage between $B_1$ and A has split, $B_2$ represents a group that will split from RED when reacting with an alkali, hydroxylamine or sulfite ion that is present when development is carried out, RED represents a group that will have an oxidizable structure only after the linkages between RED and $B_1$ and between RED and $B_2$ have split and will split from D which has the same meaning as defined in formula (I)) when oxidized, and v and w are each 0 or 1.

4. A silver halide color photographic material of claim 3, wherein the group represented by RED has the following formula (R-1):

$$*\text{—}P\text{—}X\text{—}Y_nQ\text{-}** \qquad (R\text{-}1)$$

wherein the mark * indicates the position to be attached to A—$(B_1)_v$—, and the mark ** indicates the position to be attached to $B_2$, or a hydrogen atom, and P and Q each represent an oxygen atom or a substituted or unsubstituted imino group, at least one of X in a quantity of n and y in a quantity of n represents a methylene group having, as a substituent, D, which has the same meaning as defined in the general formula (I), and the remaining X and Y may be the same or different and each represents a substituted or unsubstituted methine group or a nitrogen atom, and n is an integer of from 1 to 3, two substituents of any of which P, X, Y and Q may be divalent groups to form a ring structure.

5. A silver halide color photographic material of claim 2, wherein D comprises a compound represented by the formula (D-1):

$$******\text{—}B_{1q}DI \qquad (D\text{—}1)$$

wherein the mark ****** indicates the position to be attached to B, and $B_1$ has the same meaning as defined for the general formula (B-1) in claim 3, q is 0 or 1 and DI represents a development inhibitor.

6. A silver halide color photographic material of claim 3, wherein $B_1$ represents a group having the following general formula:

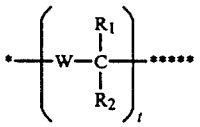

wherein the mark * indicates the position to be attached to A, and the mark ***** indicates the position to be attached to RED, W represents an oxygen atom or a group

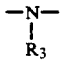

in which $R_3$ represents an organic substituent, $R_1$ and $R_2$ may be the same or different and each represents a hydrogen atom or a substituent, t is 1 of 2, and two or any of which $R_1$, $R_2$ and $R_3$ may join together to form a ring structure.

7. A silver halide color photographic material of claim 3, wherein $B_1$ represents a group that causes the split-off reaction using an intramolecular nucleophilic substitution reaction.

8. A silver halide color photographic material of claim 3, wherein $B_1$ represents a group having the following general formula:

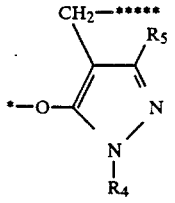

wherein the mark * indicates the position to be attached to A, and the mark ***** indicates the position to be attached to to RED, and $R_4$ and $R_5$ each represents a hydrogen atom or a substituent.

9. A silver halide color photographic material of claim 3, wherein v is 0 and w is 0.

10. A silver halide color photographic material of claim 5, wherein DI is selected from the group consisting of a tetrazolylthio group, a 1- or 2-benzoytriazolyl group, a 1-benzoindazolyl group, a benzoimidazolylthio group, a benzoxazolylthio group, an imidazolythio group, an oxazolylthio group, a triazolylthio group, an oxadiazolylthio group, a thiadiazolylthio group and an N-aryl-N-(1,2,3,4-thiatriazol-5-yl)amino group.

11. A silver halide color photographic material of claim 5, wherein q is 0.

12. A silver halide color photographic material of claim 2, wherein said compounds (a) and (b) are selected from the group consisting of those represented by the following formula (II) or (III): wherein A has the same meaning as defined in claim 2, DI represents a development inhibitor, $Q_1$ represents a hydroxyl group or a sulfonamido group, $R_6$ represents a hydrogen atom or a substituent, and r is an integer of from 1 to 3, and if r is 2 or over, $R_6$'s may be the same or different, and if two $R_6$'s represent substituents on adjacent carbon atoms, they may be divalent groups to form a benzonorbornene, a chroman, an indole, a benzothiopene, a quinoline, a benzofuran, a 2,3-dihydrobenzofuran, an indane, or an indene.

13. A silver halide color photographic material of claim 1, wherein said amount of the at least one of the compounds (a) and (b) is 0.001–0.5 mol% based on the amount of the silver halide in the unit layer highest in sensitivity.

14. A silver halide color photographic material of claim 13, wherein said amount of the at least one of the compounds (a) and (b) is 0.005–0.2 mol% based on the amount of the silver halide in the unit layer highest in sensitivity.

15. A silver halide color photographic material of claim 14, wherein said amount of the at least one of the compounds (a) and (b) is 0.005–0.1 mol% based on the amount of the silver halide in the unit layer highest in sensitivity.

* * * * *